US007284926B2

(12) United States Patent
Tanaka et al.

(10) Patent No.: US 7,284,926 B2
(45) Date of Patent: Oct. 23, 2007

(54) STICK-SHAPED COSMETIC MATERIAL CARTRIDGE

(75) Inventors: Masahiro Tanaka, Tokyo (JP); Yukikazu Ishida, Tokyo (JP)

(73) Assignee: Tokiwa Corporation, Gifu (JP)

( * ) Notice: Subject to any disclaimer, the term of this patent is extended or adjusted under 35 U.S.C. 154(b) by 243 days.

(21) Appl. No.: 11/240,463

(22) Filed: Oct. 3, 2005

(65) Prior Publication Data

US 2006/0072956 A1 Apr. 6, 2006

(30) Foreign Application Priority Data

Oct. 4, 2004 (JP) ..... 2004-291802

(51) Int. Cl.
*B43K 21/08* (2006.01)

(52) U.S. Cl. ..... 401/75; 401/68; 401/116

(58) Field of Classification Search ..... 401/68–70, 401/75, 76, 78, 108, 116
See application file for complete search history.

(56) References Cited

U.S. PATENT DOCUMENTS 6,450,715 B2 * 9/2002 Ohba ..... 401/78
6,497,524 B1 * 12/2002 Kim ..... 401/116
6,764,239 B2 * 7/2004 Kim ..... 401/108
7,044,667 B2 * 5/2006 Tanaka et al. ..... 401/75

* cited by examiner

*Primary Examiner*—Tuan Nguyen
(74) *Attorney, Agent, or Firm*—Bacon & Thomas, PLLC

(57) ABSTRACT

To improve a quality without deteriorating feeding function, a stick-shaped cosmetic material cartridge is structured such that, a rear inner tube (12) is received in an outer tube (10) to be rotatable and immobile in an axial direction, a front inner tube (13) is coupled to the rear inner tube (12) to be mobile in the axial direction and non-rotatable and is energized rearward by an energizing means (16) to be received in the outer tube (10), and a male thread (14*f*) of a thread stick (14) supporting a stick-shaped cosmetic material (M) and provided with the male thread (14*f*) is engaged with a female thread (13*x*) in an inner portion of the front side inner tube (13), whereby the cosmetic material (M) rises and sets smoothly and, even if an impact is applied, is well protected from being loosened off and broken.

7 Claims, 26 Drawing Sheets

STICK-SHAPED COSMETIC MATERIAL CARTRIDGE

TECHNICAL FIELD

The present invention relates to a stick-shaped cosmetic material cartridge in which a stick-shaped cosmetic material can rise and set from a cartridge.

BACKGROUND ART

Conventionally, as a stick-shaped cosmetic material feeding container, there has been known a stick-shaped cosmetic material feeding container structured such that a rear end portion of a leading tube and a front end portion of a shaft tube are connected so as to be rotatable and immovable in an axial direction, a spiral tube having a female thread in an inner portion and a plurality of axially longer protrusions in a peripheral direction in an outer portion is inward inserted to the shaft tube, a plurality of axially longer grooves provided along a peripheral direction in an inner portion of the shaft tube are engaged with the protrusions in an outer portion of the spiral tube, whereby the spiral tube is received so as to be non-rotatable and movable in the axial direction, a retractable shaft holding a rear end portion of a stick-shaped cosmetic material in a front end portion, having a male thread projection in a rear end portion and forming a noncircular shape is inward inserted to the leading tube and the spiral tube, a front end side of the noncircular retractable shaft is slidably received in a noncircular guide opening formed along the axial direction within the leading tube and coinciding with the noncircular shape of the retractable shaft, the male thread projection in the rear end portion of the retractable shaft is engaged with the female thread in the inner portion of the spiral tube, and a compression spring is arranged between the rear end surface of the leading tube and the front end surface of the spiral tube so as to press the spiral tube to a closed-end portion of the shaft tube, wherein if the leading tube and the shaft tube are relatively rotated, the retractable shaft moves forward and backward and the stick-shaped cosmetic material rises and sets with respect to the front end of the leading tube, by a rotation preventing mechanism constituted by the noncircular retractable shaft and the guide opening, and a engagement mechanism constituted by the male thread projection of the retractable shaft and the female thread of the spiral tube, and even if an impact is applied or a vibration is applied, for example, by dropping the stick-shaped cosmetic material feeding container, the spiral tube and the retractable shaft moves forward while compressing the compression spring, absorbs the impact and the vibration on the basis of the forward movement and a compression effect of the compression spring, and prevents the stick-shaped cosmetic material from being detached away from the retractable shaft and broken (for example, refer to Japanese Utility Model Publication No. 2-33703).

Further, there has been known a stick-shaped cosmetic material feeding container structured such that a feeding container feeding a stick-shaped cosmetic material is attached as a stick-shaped cosmetic material cartridge to one end side of a cylindrical container, and to the other end side, there is attached, for example, a liquid cosmetic material cartridge, a stick-shaped cosmetic material cartridge having an other stick-shaped cosmetic material than the stick-shaped cosmetic material in the one end side, an applicator or the like, thereby diversifying an intended use (for example, refer to Japanese Utility Model Publication No. 4-30961). The stick-shaped cosmetic material cartridge attached to the stick-shaped cosmetic material feeding container is structured such as to be provided with a core chuck holding the rear end portion of the stick-shaped cosmetic material in the front end portion and provided with a guide projection serving as the male thread in the rear end portion, a spiral tube provided with a spiral groove with which the guide projection of the core chuck is engaged in an inner portion, and a cartridge main body receiving the core chuck in a front side thereof so as to be non-rotatable and slidable in the axial direction, and receiving the spiral tube in a rear side thereof so as to be rotatable and immobile in the axial direction, the stick-shaped cosmetic material cartridge is attached to a coupling container so as to be rotatable and detachable (or undetachable), a projection portion (a locking portion) provided in an approximately center portion in the axial direction within the coupling container and protruding to the stick-shaped cosmetic material cartridge side is engaged with a knurled portion (a locking portion) provided in an inner portion of a rear end portion of the spiral tube on the basis of the attachment, the spiral tube is engaged with the coupling container so as to be non-rotatable and is structured such that a rotational force of the coupling container is applied thereto from a rear side thereof, the spiral tube and the cartridge main body are relatively rotated on the basis of a relative rotation of the coupling container and the cartridge main body, and the core chuck moves forward and backward and the stick-shaped cosmetic material rises and sets with respect to the front end of the cartridge main body by the rotation preventing mechanism constituted by the core chuck and the cartridge main body, and the engagement mechanism constituted by the guide projection of the core chuck and the spiral groove of the spiral tube.

DISCLOSURE OF THE INVENTION

Problem to be Solved by the Invention

Meanwhile, in recent years, a higher quality is required to the latter stick-shaped cosmetic material cartridge, and it is required to employ a mechanism absorbing the impact and the vibration to prevent the stick-shaped cosmetic material from breaking away and being broken like as the former stick-shaped cosmetic material feeding container, however, there is no stick-shaped cosmetic material cartridge employing the mechanism mentioned above.

The present invention is made for the purpose of solving the problem mentioned above, and an object of the present invention is to provide a stick-shaped cosmetic material cartridge which prevents a stick-shaped cosmetic material from being loosened off and being broken due to an impact and an operation of a vibration so as to improve a quality without deteriorating a feeding function in comparison with a prior art.

Means for Solving the Problem

In accordance with a research of the inventors of the present application, if the structure of the stick-shaped cosmetic material feeding container as described in the Japanese Utility Model Publication No. 2-33703 is simply employed for the stick-shaped cosmetic material cartridge as described in the Japanese Utility Model Publication No. 4-30961, that is, if employing the structure in which the spiral tube is received in the cartridge main body so as to be rotatable and movable in the axial direction, and the rotational force of the coupling container is applied from the rear side of the spiral tube in a state of energizing the spiral tube to the rear side by the compression spring and maintaining the engagement in the rotational direction between the locking portion of the rear end portion of the spiral tube and the locking portion of the coupling container, in the case that the impact or the vibration is applied to the stick-shaped cosmetic material feeding container to which the stick-shaped cosmetic material cartridge is attached, and the spiral tube and the core chuck move forward while compressing the compression spring, the engagement between the rear end portion of the spiral tube and the coupling container is detached, so that there is a risk that the engagement between the rear end portion of the spiral tube and the coupling container is not restored if they are shifted in the rotational direction even when the impact and the vibration end and the spiral tube is energized to the rear side by the compression spring.

Then, in accordance with the present invention, there is provided a stick-shaped cosmetic material cartridge comprising:

a thread stick supporting a rear end portion of a stick-shaped cosmetic material and provided with a male thread in an outer portion;

an inner tube provided with a female thread engaged with the male thread in an inner portion; and an outer tube receiving the thread stick in a front side so as to be non-rotatable and slidable in an axial direction and receiving the inner tube in a rear side;

the stick-shaped cosmetic material being moved forward and backward on the basis of a relative rotation between the outer tube and the inner tube so as to rise and set with respect to a front end of the outer tube, wherein the inner tube has a rear side inner tube which is received in the outer tube so as to be rotatable and immobile in an axial direction and is relatively rotated with the outer tube on the basis of a rotational force applied from a rear side, and a front side inner tube which has the female thread in an inner portion and is coupled to the rear side inner tube so as to be movable in the axial direction and non-rotatable and is received in the outer tube, and an energizing means for energizing the front side inner tube to a rear side is arranged between an inner portion of the outer tube and an outer portion of the front side inner tube.

In accordance with the stick-shaped cosmetic material cartridge as mentioned above, the rear side inner tube is structured such as to be received in the outer tube so as to be rotatable and immobile in the axial direction and be applied the rotational force from the rear side, the front side inner tube is structured such as to be coupled to the rear side inner tube so as to be movable in the axial direction and non-rotatable and be received in the outer tube in a state of being energized to the rear side by the energizing means, and the front side inner tube is structured such that the male thread of the thread stick supporting the rear end portion of the stick-shaped cosmetic material and provided with the male thread in the outer portion is engaged with the female thread in the inner portion of the front side inner tube. Accordingly, if the rotational force is applied to the rear side inner tube from the rear side, the rear side inner tube is relatively rotated with respect to the outer tube together with the front side inner tube, and the thread stick smoothly moves forward and backward and the stick-shaped cosmetic material well rises and sets with respect to the front end of the outer tube by the rotation preventing mechanism constituted by the inner portion in the front side of the outer tube and the thread stick, and the engagement mechanism constituted by the male thread of the thread stick and the female thread of the front side inner tube. On the other side, if the impact or the vibration is applied to the stick-shaped cosmetic material feeding container to which the stick-shaped cosmetic material cartridge is attached, the rear side inner tube is not moved in the axial direction, and accordingly maintains the state in which the rotational force is securely applied from the rear side to the rear side inner tube, and the front side inner tube moves forward against the energizing force of the energizing means together with the thread stick engaging with the front side inner tube in a state of leaving the rear side inner tube, so that the impact and the vibration are absorbed on the basis of the forward movement and a damping effect of the energizing means, and it is possible to prevent the stick-shaped cosmetic material from being loosened off from the thread stick and being broken. Further, when the impact and the vibration end, the energizing means springs the front side inner tube to move the front side inner tube backward, and the front side inner tube and the thread stick are returned to the original positions.

In this case, as the structure of the inner tube preferably achieving the effect mentioned above, in particular, there is a structure in which the front side inner tube is provided with a plurality of slits extending in the axial direction and open to the rear side along a peripheral direction, and extending walls positioned in both sides in the peripheral direction of the slits so as to form the slits and extending in the axial direction, in the rear side, the rear side inner tube is provided with a plurality of slits extending in the axial direction, open to the front side and to which the extending walls of the front side inner tube enter in the axial direction along the peripheral direction, and is provided with extending walls positioned in both sides in the peripheral direction of the slits so as to form the slits, extending in the axial direction and enters to the slits of the front side inner tube in the axial direction, and the front side inner tube is coupled to the rear side inner tube so as to be movable in the axial direction and non-rotatable by the slits and the extending walls.

Further, if the slits formed between the extending walls in the peripheral direction and the extending walls entering to the slits are formed in such a shape as to constrain deformation of the extending walls in a thickness direction, in the case that the inward deformation is constrained, it is possible to prevent an interference of the thread stick arranged in the inner side with the male thread and it is possible to secure a desired movement of the thread stick, and in the case that the outward deformation is constrained, and in the case that the energizing means such as the coil spring or the like is for example arranged in the outer side, it is possible to prevent an interference with the energizing means and it is possible to secure a desired movement.

In this case, as a preferable shape constraining the inward deformation of the extending wall, in particular, there is an approximate fan-shape in cross section, in which the inner peripheral surface and the outer peripheral surface are formed to be circular arc shaped surfaces and the outer peripheral surface is made longer than the inner peripheral surface.

Further, the structure may be made such that an annular portion coupling a front end portion of each of the extending walls in any one of the front side and rear side inner tubes along the peripheral direction is provided, and the annular portion is provided with grooves connecting to the slits of one inner tube provided with the annular portion in the axial direction and allowing the extending walls of the other inner tube to enter to the slits in the axial direction, in an inner peripheral surface. Accordingly, it is possible to securely make the extending walls of the other inner tube enter into the slits of one inner tube having the annular portion and it is possible to securely make the slits of the other inner tube into the extending walls of one inner tube having the annular portion in the axial direction, on the basis of the grooves of the annular portion. Further, each of the extending walls of one inner tube having the annular portion is reinforced by the annular portion, and the deformation of each of the extending walls in the thickness direction is well constrained.

EFFECT OF THE INVENTION

As mentioned above, in accordance with the present invention, since the stick-shaped cosmetic material well rises and sets with respect to the front end of the outer tube, and it is possible to prevent the stick-shaped cosmetic material from being loosened off and being broken due to the effect of the impact and the vibration, it is possible to improve a quality without deteriorating the feed-out function in comparison with the prior art.

BEST MODE FOR CARRYING OUT THE INVENTION

Figure 3:
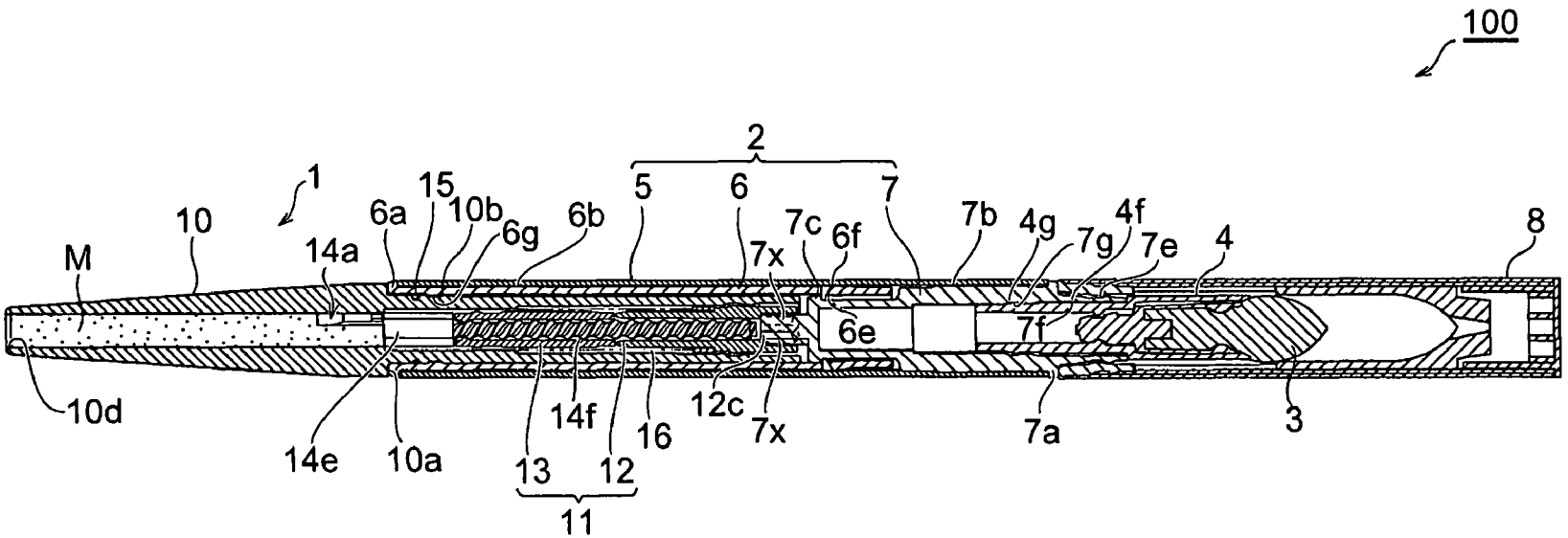
FIG. 3 is a longitudinal sectional view of the stick-shaped cosmetic material feeding container shown in FIG. 1, and shows a state before feeding the stick-shaped cosmetic material.
Figure 4:
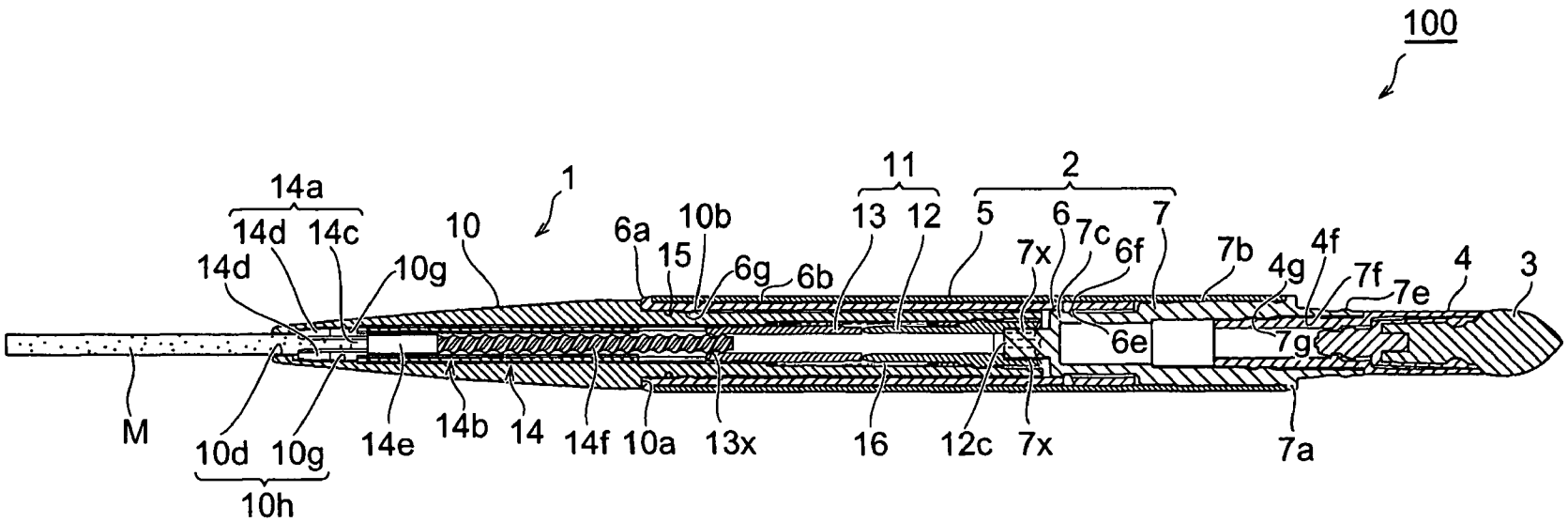
FIG. 4 is an orthogonal longitudinal sectional view of the stick-shaped cosmetic material feeding container, and shows a state in which the cap of the applicator is detached and the stick-shaped cosmetic material is fed to a forward limit.
Figure 5:
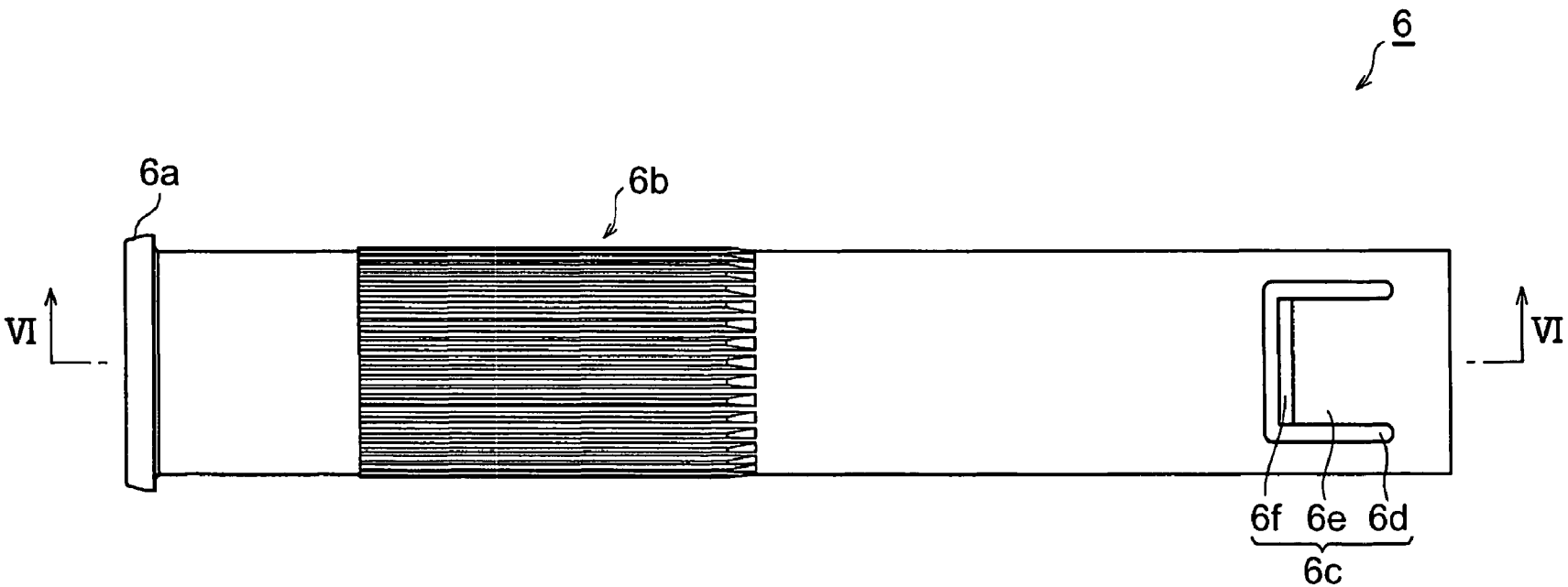
FIG. 5 is a side view showing a first holder in FIGS. 3 and 4.
Figure 6:
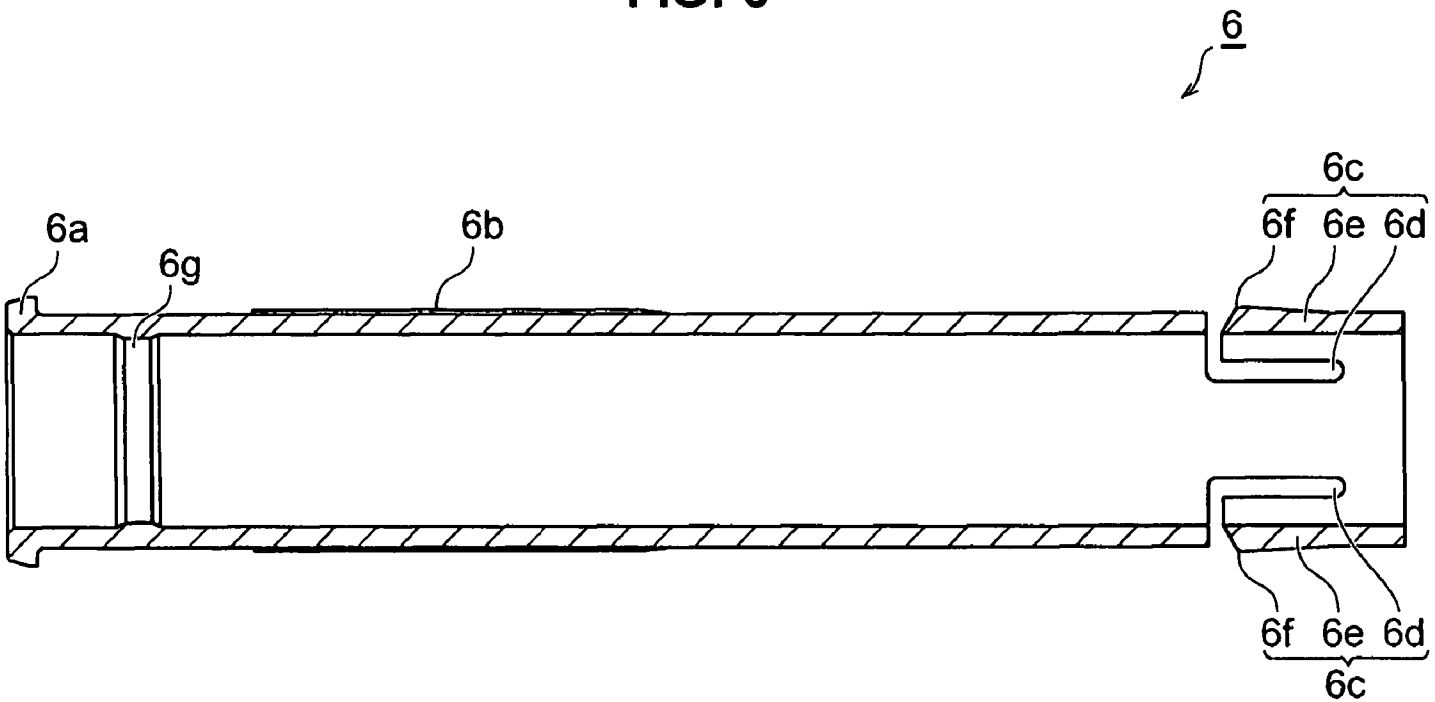
FIG. 6 is a view as seen along a line VI-VI in FIG. 5.
Figure 7:
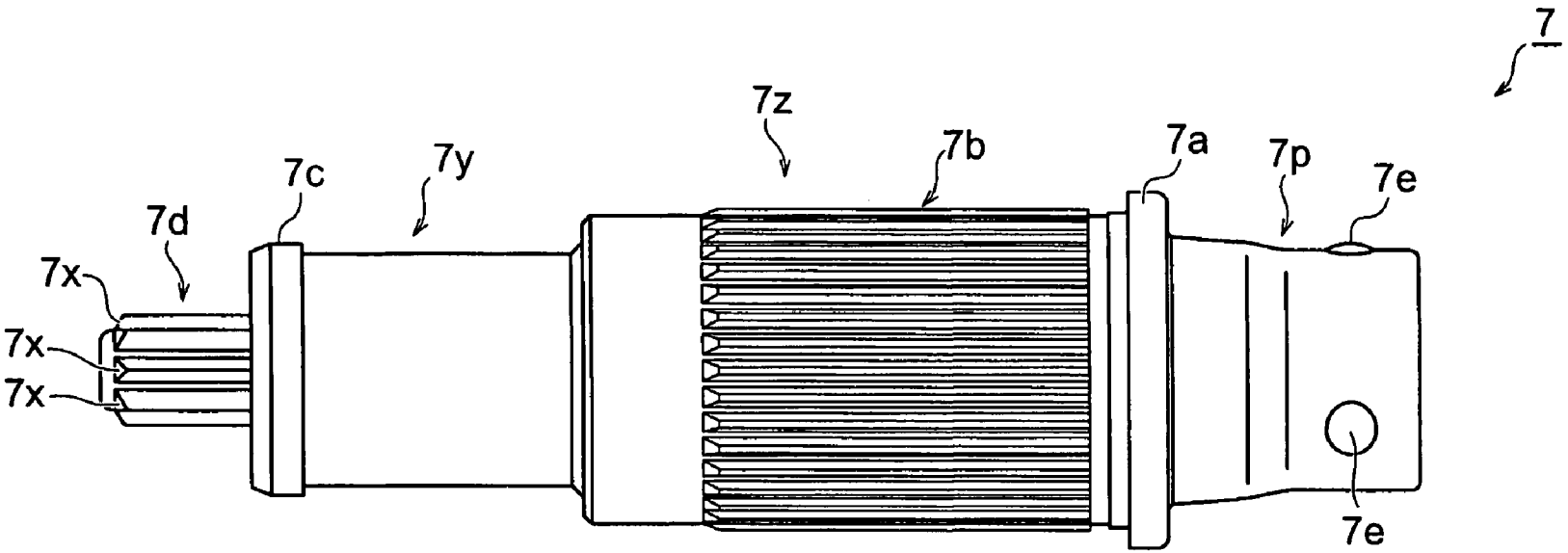
FIG. 7 is a side view showing a second holder in FIGS. 3 and 4.
Figure 8:
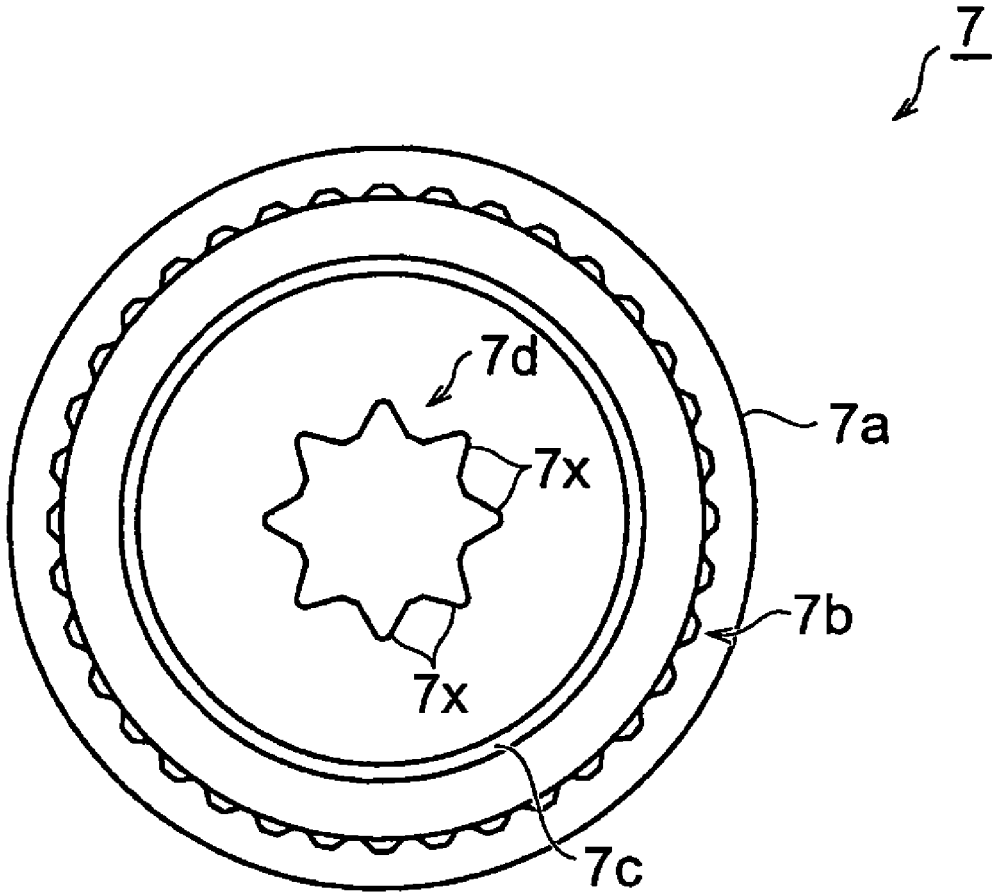
FIG. 8 is a left side view of the second holder shown in FIG. 7.
Figure 9:
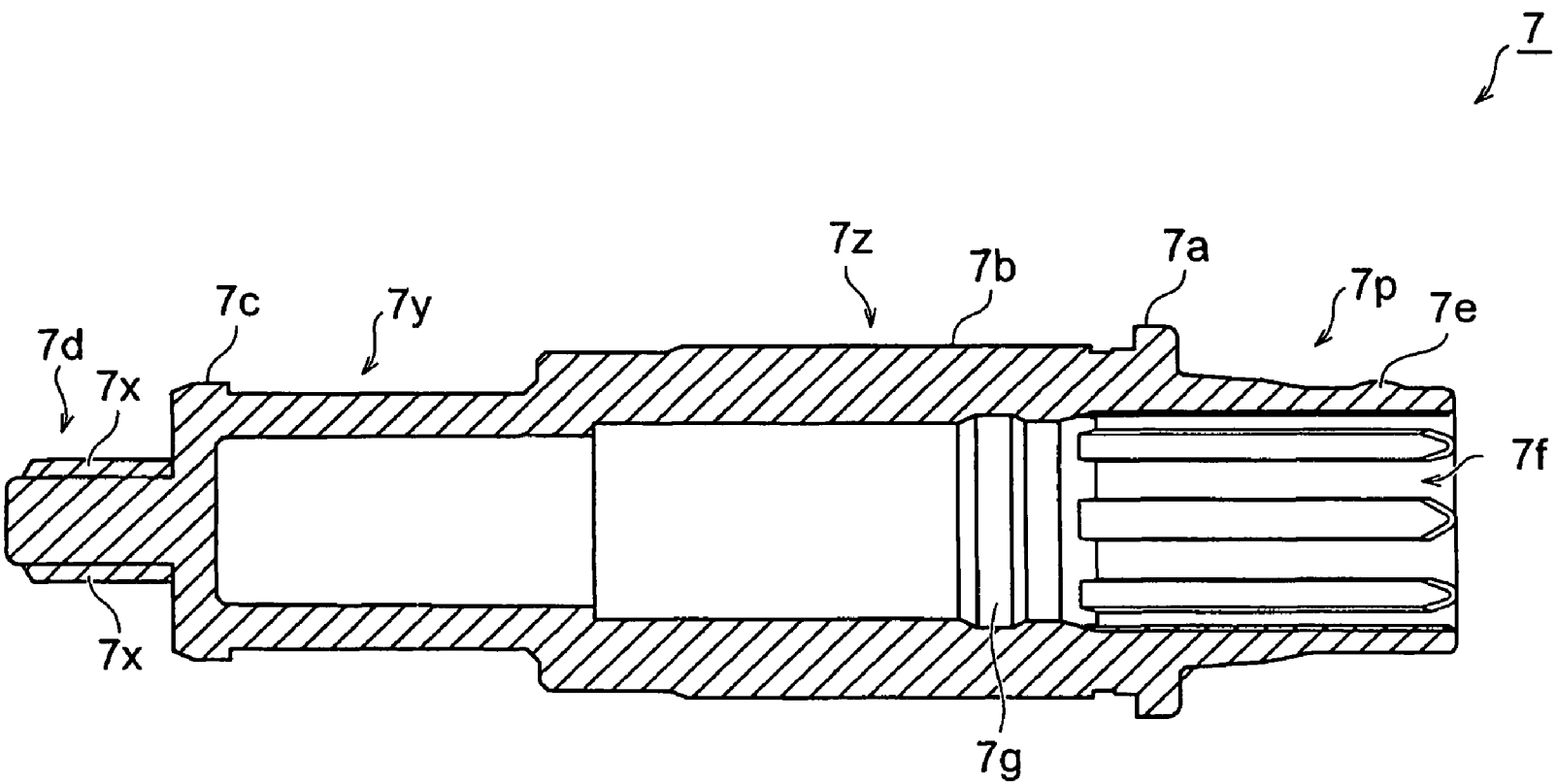
FIG. 9 is a longitudinal sectional view of the second holder shown in FIG. 7.
Figure 10:
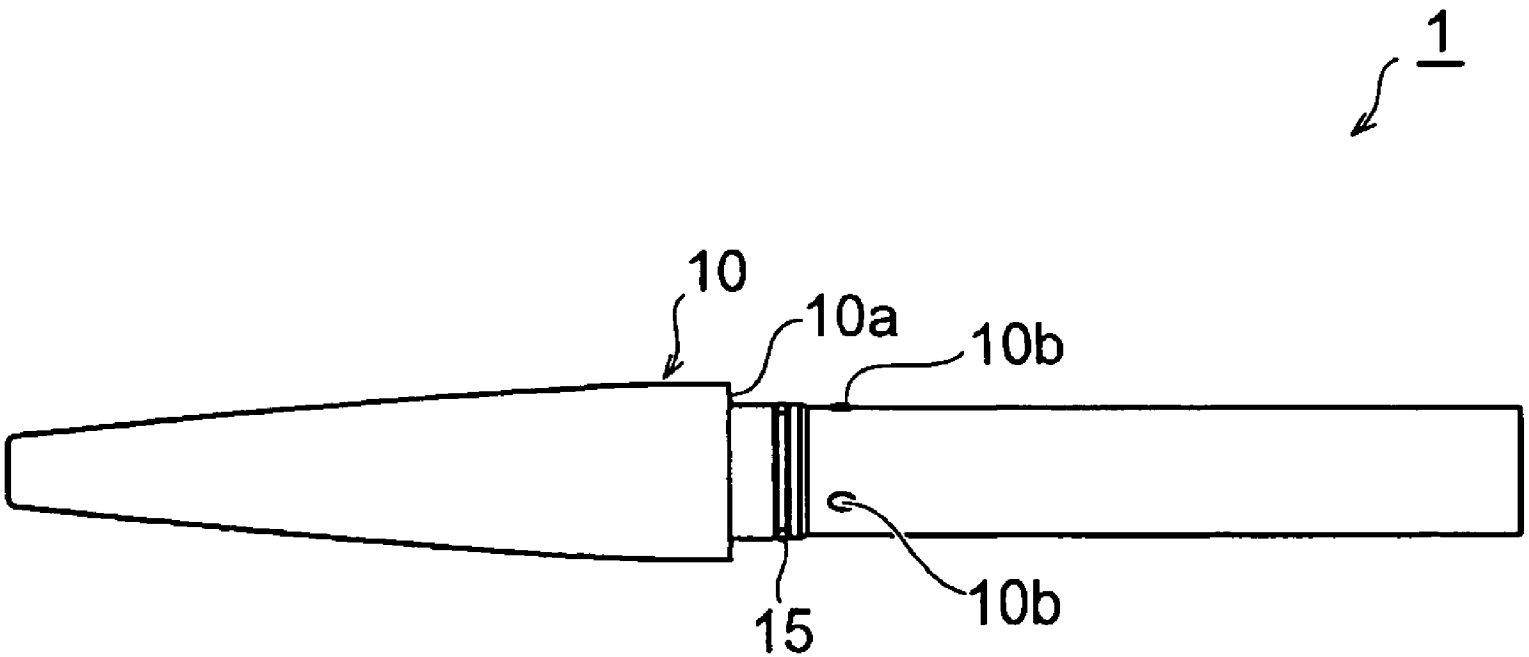
FIG. 10 is a side view showing a stick-shaped cosmetic material cartridge in FIGS. 1 to 4.
Figure 11:
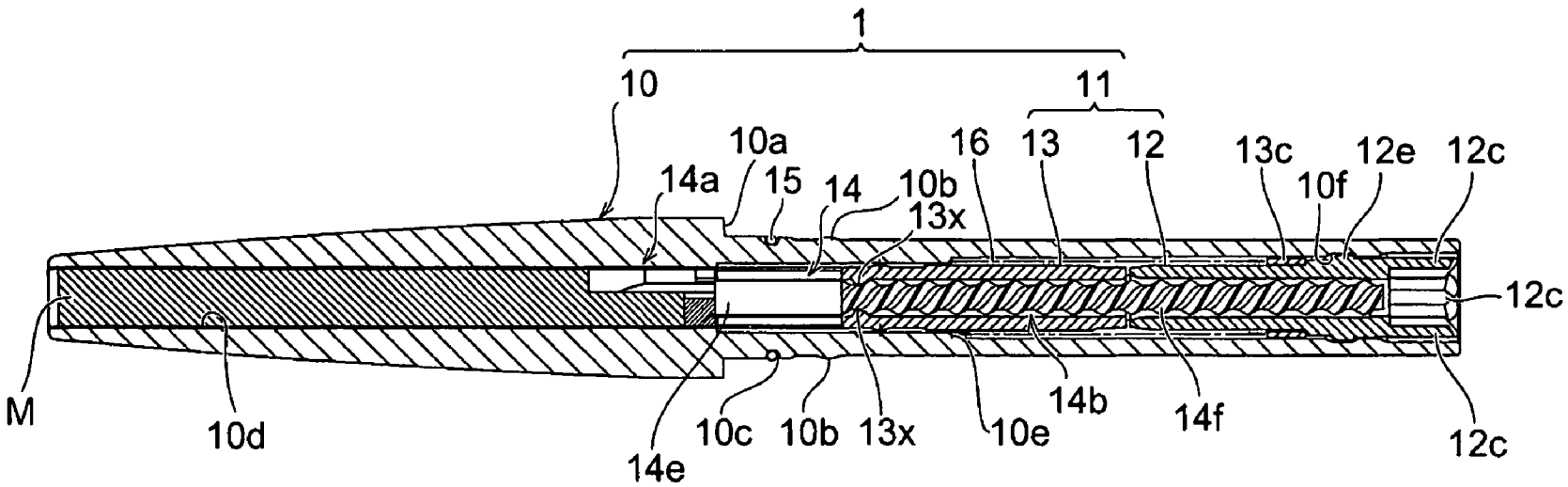
FIG. 11 is a longitudinal sectional view of the stick-shaped cosmetic material cartridge shown in FIG. 10.
Figure 12:
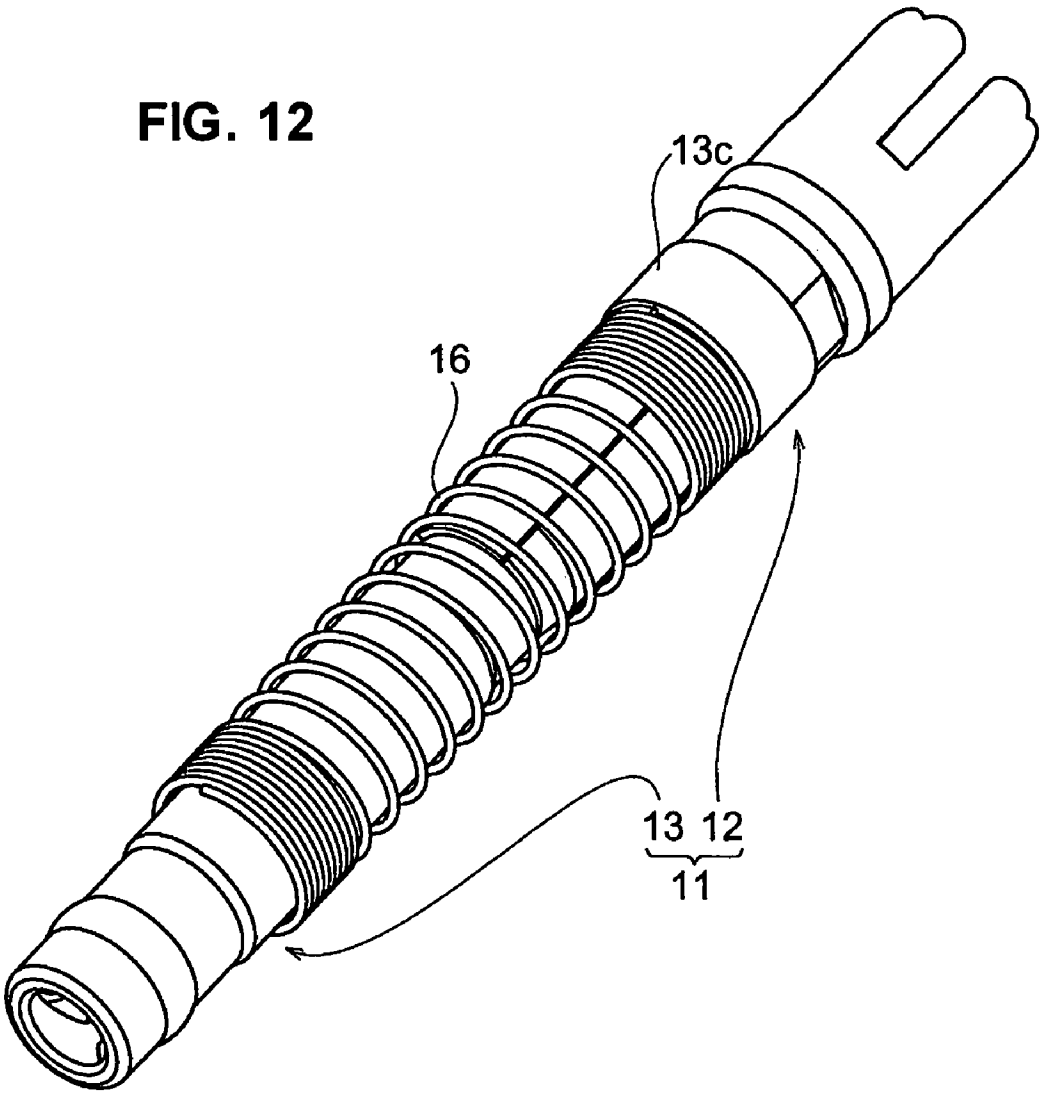
FIG. 12 is a perspective view showing front side and rear side inner tubes in FIG. 11 and a compression coil spring.
Figure 13:
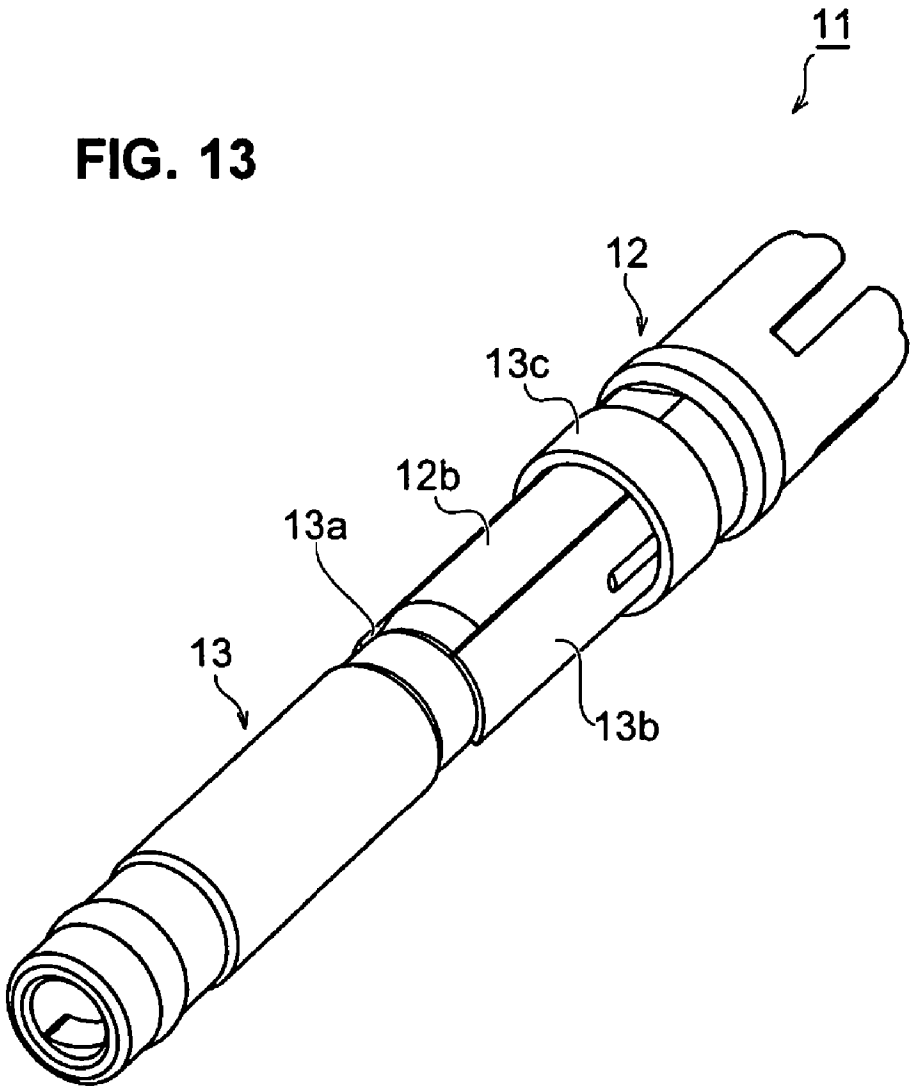
FIG. 13 is a perspective view showing the front side and rear side inner tubes in FIG. 11.
Figure 14:
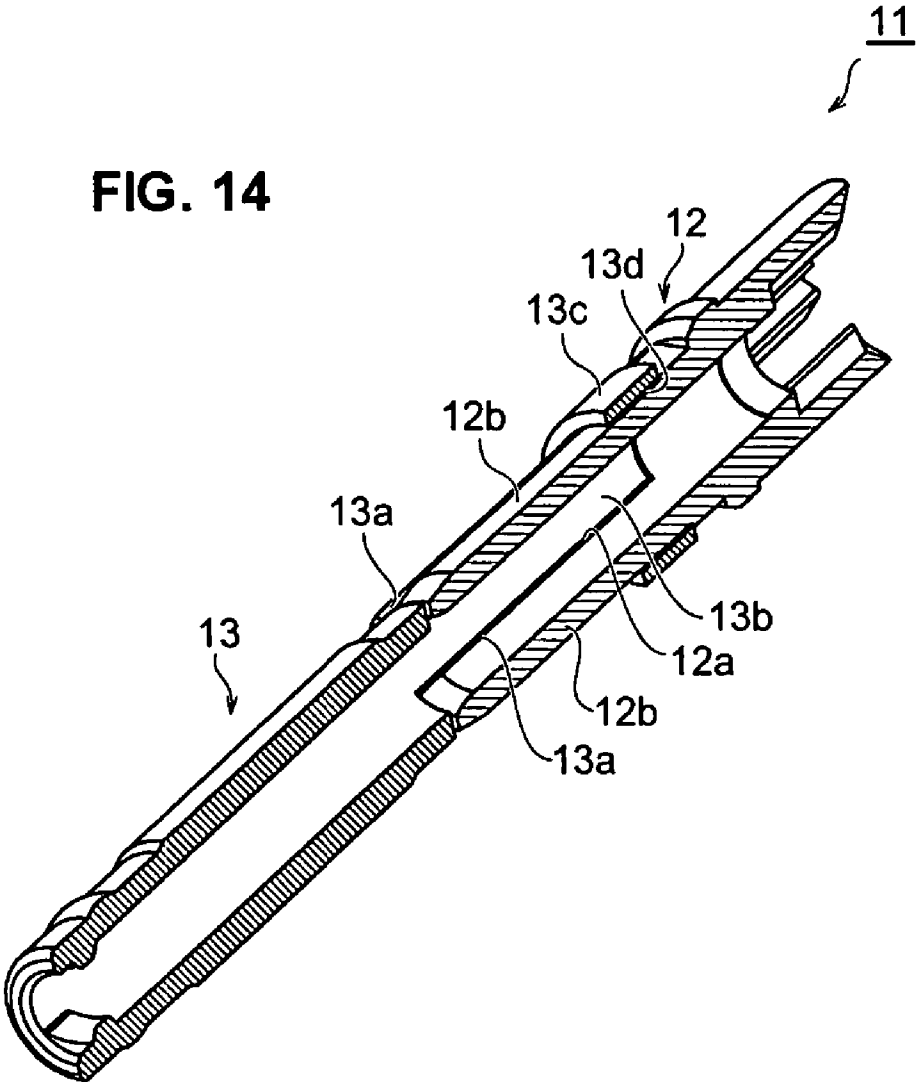
FIG. 14 is a longitudinal sectional perspective view of the inner tube shown in FIG. 13.
Figure 15:
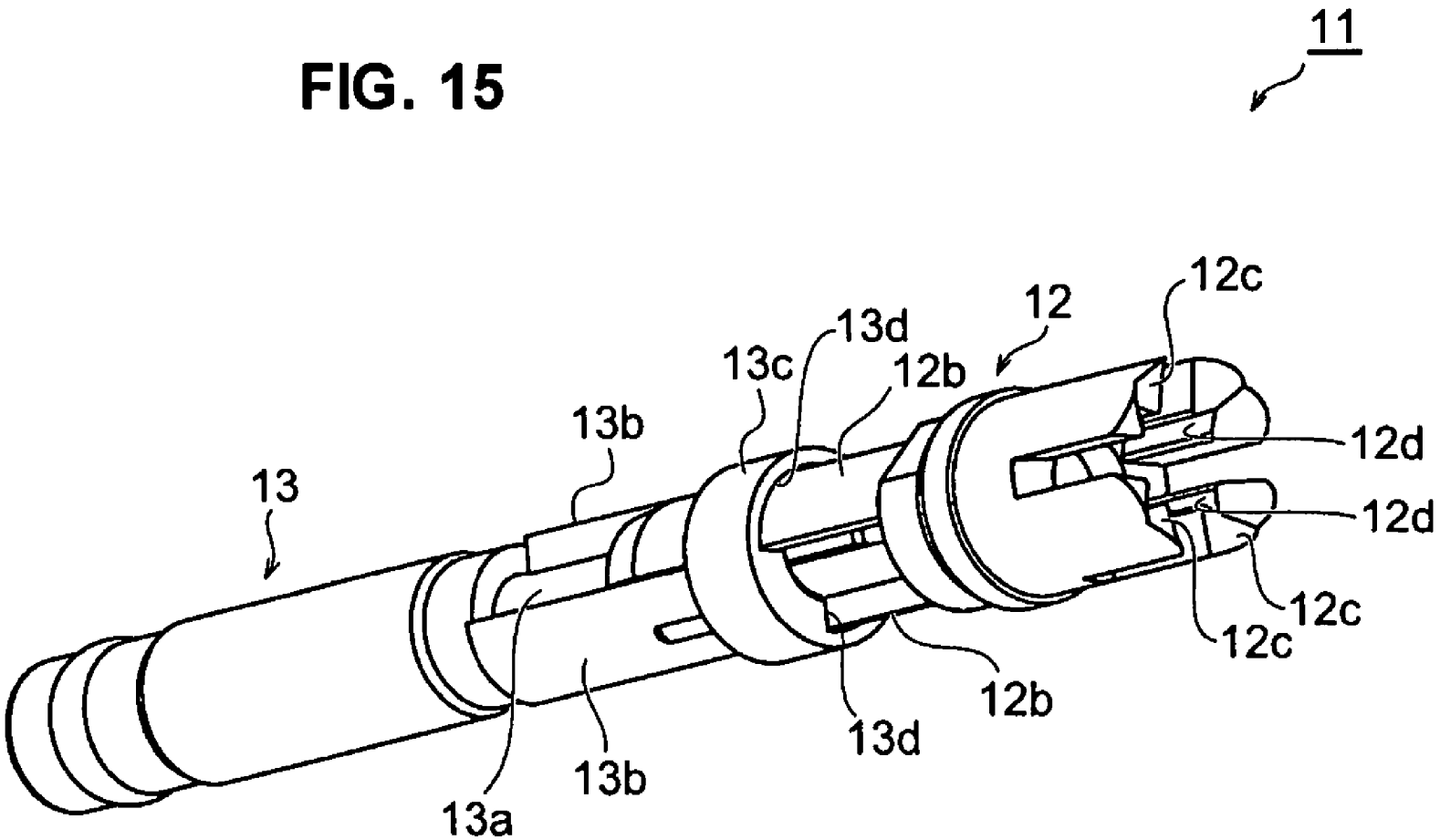
FIG. 15 is a perspective view of the inner tube shown in FIG. 13 as seen from an opposite side in an axial direction.

A description will be given below of a preferable embodiment of a stick-shaped cosmetic material cartridge in accordance with the present invention with reference to FIGS. 1 to 26. In this case, in each of the drawings, the same reference numerals are attached to the same elements and an overlapping description will be omitted. FIGS. 1 to 4 are respective views showing a stick-shaped cosmetic material feeding container provided with a stick-shaped cosmetic material cartridge, FIGS. 5 and 6 are respective views showing a first holder of a cartridge receiving container to which the stick-shaped cosmetic material cartridge is attached, FIGS. 7 to 9 are respective views showing a second holder of the cartridge receiving container, FIGS. 10 and 11 are respective views showing the stick-shaped cosmetic material cartridge, FIG. 12 is a perspective view showing front side and rear side inner tubes and a compression coil spring, FIGS. 13 to 16 are respective views showing the front side and rear side inner tubes, FIGS. 17 to 20 are respective views showing the rear side inner tube, and FIGS. 21 to 26 are respective views showing the front side inner tube. The stick-shaped cosmetic material feeding container provided with the stick-shaped cosmetic material cartridge in accordance with the present embodiment receives various solid stick-shaped cosmetic materials, for example, an eyeliner, an eyebrow, a lip liner or the like, and the stick-shaped cosmetic material can appropriately rise and set in accordance with necessity of a user.

Figure 1:
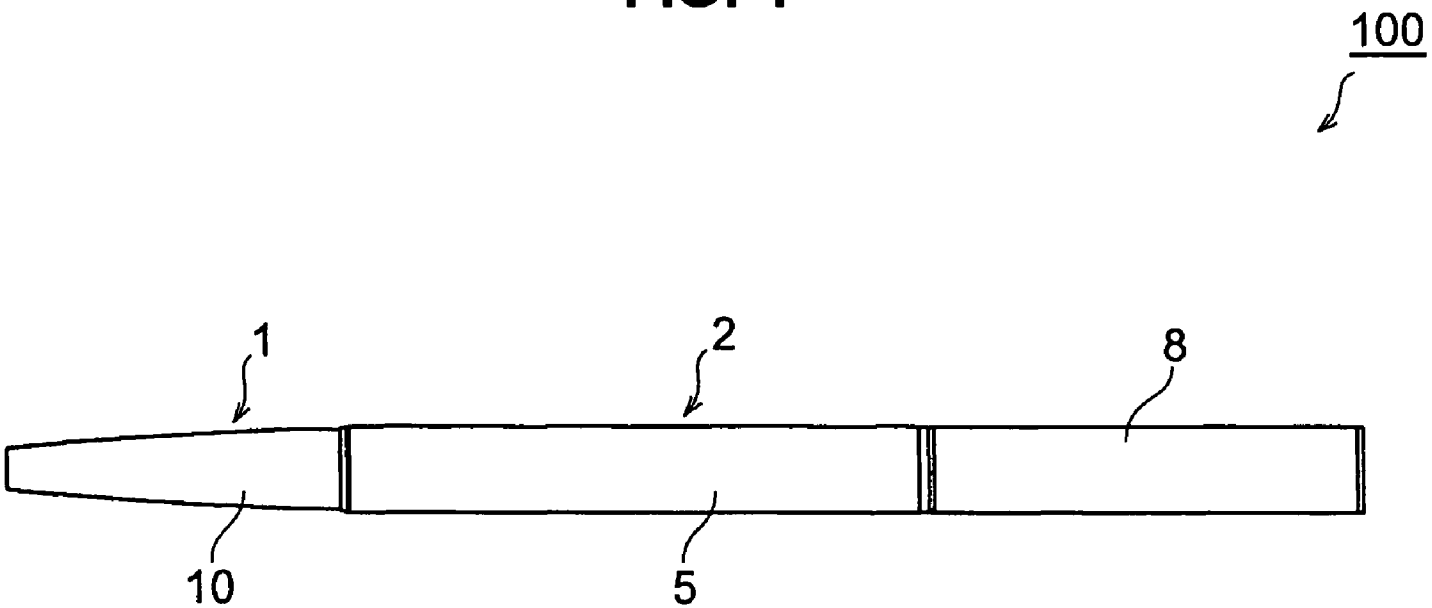
FIG. 1 is a side view showing a stick-shaped cosmetic material feeding container provided with a stick-shaped cosmetic material in accordance with an embodiment of the present invention.
Figure 2:
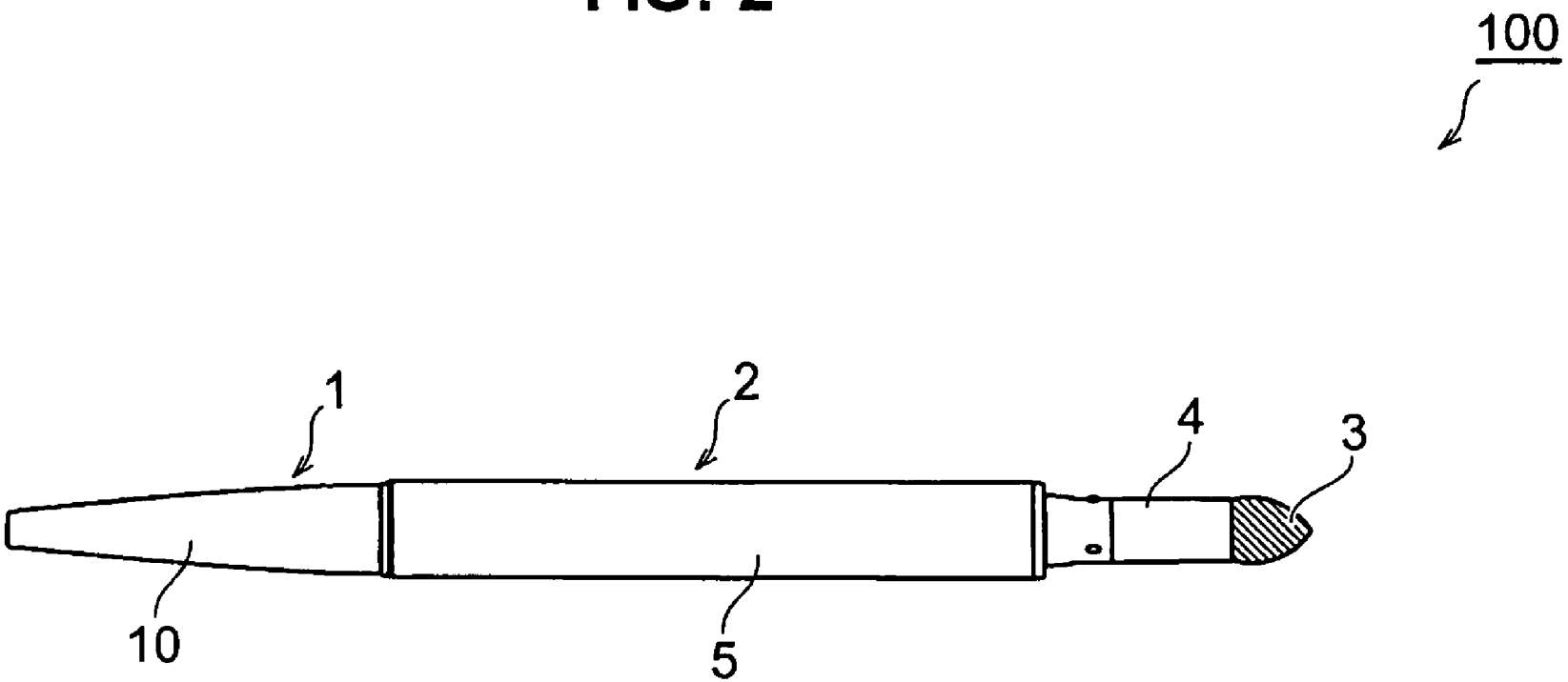
FIG. 2 is a side view showing a state in which a cap of an applicator of the stick-shaped cosmetic material feeding container shown in FIG. 1 is detached.

As shown in FIG. 1, a stick-shaped cosmetic material feeding container 100 is formed in an elongated round stick shape like as a writing implement in an entire shape and has a good outer appearance. As shown in FIGS. 3 and 4, the stick-shaped cosmetic material feeding container 100 is provided with a stick-shaped cosmetic material cartridge 1 receiving a stick-shaped cosmetic material M detachably in one end side (a left side in the drawing) of a cartridge receiving container 2, as shown in FIGS. 1 to 4, and is provided with an applicator holder 4, to which an applicator (a chip in the present embodiment) 3 is attached, is provided undetachably in the other end side of the cartridge receiving container 2.

The cartridge receiving container 2 is structured such as to have a cylindrical shaft tube 5 forming an outer tube, and a first holder 6 and a second holder 7 received in the shaft tube 5 and forming an inner tube, as shown in FIGS. 3 and 4. The first holder 6 is attached to one side of the shaft tube 5, and the second holder 7 is attached to the other side of the shaft tube 5.

The first holder 6 is made of a flexible material, for example, a synthetic resin or the like, and is structured in an approximately cylindrical shape as shown in FIGS. 5 and 6. A large-diameter collar portion 6*a* is provided in a leading end (a left end in the drawing) in the first holder 6. Further, a predetermined length of knurled portions 6*b* for attaching to the shaft tube 5 is provided thickly in line along a circumferential direction, in an outer peripheral surface in a front end side of the first holder 6, and elastic locking portions 6*c* and 6*c* are respectively provided at 180 degree symmetric positions with respect to an axis in a rear portion side thereof.

The elastic locking portions 6*c* are formed by C-shaped slots 6*d* pierced in a peripheral wall of the first holder 6, and are provided with peninsular portions 6*e* serving as leaf springs in accordance with flexibility of a synthetic resin or the like corresponding to a molding material, and locking protruding portions 6*f* protruding from outer peripheral surfaces of the peninsular portions 6*e*. Further, the first holder 6 is provided with an annular protruding portion 6*g* for locking the main body tube 10 of the stick-shaped cosmetic material cartridge 1 in the axial direction in an inner peripheral surface in a front end side thereof.

The first holder 6 is pressure inserted into the shaft tube 5 from a rear portion side thereof. As shown in FIGS. 3 and 4, the collar portion 6*a* is brought into contact with one end surface (a left side end surface in the drawing) of the shaft tube 5, the knurled portion 6*b* is brought into pressure contact with the inner peripheral surface of the shaft tube 5, and in addition, the locking protruding portions 6*f* of the peninsular portions 6*e* forming the leaf springs are brought into pressure contact with the inner peripheral surface of the shaft tube 5 so as to be locked, thereby the first holder 6 being attached to the shaft tube 5 so as to be non-rotatable and immobile in the axial direction. In this case, the locking protruding portions 6*f* of the peninsular portions 6*e* forming the leaf springs function for the knurled portions 6*b* at a time when the function of the knurled portions 6*b* weakens. Further, in this state, the peninsular portions 6*e* are bent on the basis of the pressure contact with the inner peripheral surface of the shaft tube 5, and are set in a state of protruding slightly inward from the inner peripheral surface of the first holder 6.

The second holder 7 is made of a flexible material, for example, a synthetic resin or the like, is formed in a stepped cylindrical shape as shown in FIGS. 7 to 9, and is structured such that a rear end side (a left side in the drawing) is formed as an outer diameter small-diameter portion 7*y*, whereby a front end side (a right side in the drawing) is formed as an outer diameter large-diameter portion 7*z*. The second holder 7 is provided with a large-diameter collar portion 7*a* in front end of the outer diameter large-diameter portion 7*z*, and is provided with knurled portions 7*b* having a predetermined length for being attached to the shaft tube 5 thickly inline along a circumferential direction, at a position on the rear portion side from the collar portion 7*a* on an outer peripheral surface of the outer diameter large-diameter portion 7*z*.

Further, the second holder 7 is provided with a large-diameter collar portion 7*c* functioning as a disengagement prevention of the second holder 7, in a rear end of the outer diameter small-diameter portion 7*y*, and is provided with an engagement portion 7*d* protruding rearward on a rear end surface of the outer diameter small-diameter portion 7*y*. The engagement portion 7*d* is provided for engaging the inner tube 12 in the rear side of the stick-shaped cosmetic material cartridge 1 in a rotational direction (details are mentioned below), and is formed, as shown in FIGS. 7 and 9, in a shape in which a plurality of (eight in the present embodiment) protruding portions 7*x* extending in the axial direction and having a triangular chevron cross sectional shape as shown in FIG. 8, on an outer peripheral surface of a short shaft body extending at a predetermined length in the axial direction.

Further, the second holder 7 is structured, as shown in FIGS. 7 and 9, such that a front end side from the collar portion 7*a* of the outer diameter large-diameter portion is formed as an outer diameter small-diameter portion 7*p*, and protruding portions (so-called dowel joints) 7*e* for detachably locking the cap 8 in the axial direction are provided at three uniform positions in the peripheral direction on an outer peripheral surface of the outer diameter small-diameter portion 7*p*. Further, the second holder 7 is provided with knurled portions 7*f* having a predetermined length for engaging the applicator holder 4 in the rotational direction in line along the circumferential direction, on an inner peripheral surface in a front end side, as shown in FIG. 9, and is provided with an annular groove 7*g* for engaging the applicator holder 4 in the axial direction at a position at the rear portion side from the knurled portion 7*f* on the inner peripheral surface.

The second holder 7 is pressure inserted to the shaft tube 5 from a rear portion side thereof, the collar portion 7*a* is brought into contact with the other end surface (a right side end surface in the drawing) and the knurled portion 7*b* is brought into pressure contact with the inner peripheral surface of the shaft tube 5 as shown in FIGS. 3 and 4, whereby the second holder 7 is attached to the shaft tube 5 so as to be non-rotatable and immobile in the axial direction. In this state, the inward bent portion of the peninsular portion 6*e* of the first holder 6 is positioned in a front end side (a right side in the drawing) from the collar portion 7*c* of the second holder 7 so as to inhibit the movement to the front end side (the right side in the drawing), and prevents the second holder 7 from being loosen off at a time when the function of the knurled portions 7*b* weakens, on the basis of the bent portion and the collar portion 7*c* of the second holder 7.

Further, the applicator holder 4 to which the applicator 3 is attached is inside inserted to the second holder 7, the annular protruding portion 4*g* provided in the outer peripheral surface of the applicator holder 4 is engaged with the annular groove 7*g* of the second holder 7 in the axial direction, and the knurled portions 4*f* provided in the outer peripheral surface of the applicator holder 4 are engaged with the knurled portions 7*f* of the second holder 7 in the rotational direction, whereby the applicator holder 4 is attached to the second holder 7. Further, the cap 8 covering and protecting the applicator 3 is brought into contact with the protruding portions 7*e* of the second holder 7 by the inner peripheral surface, thereby being detachably fitted to the second holder 7.

On the other hand, the stick-shaped cosmetic material cartridge 1 is approximately structured, as shown in FIGS. 10 and 11, such that the stick-shaped cosmetic material cartridge 1 is provided with the main body tube 10 forming the cylindrical shape and serving as the outer tube extending in the axial direction, an inner tube 11 received in the main body tube 10 and having a female thread structuring an engagement mechanism as shown in FIG. 11, and a thread stick 14 received in the main body tube 10, extending in the axial direction, supporting the stick-shaped cosmetic material M in a front end and having a male thread structuring an engagement mechanism, and when relatively rotating the main body tube 10 and the inner tube 11, the thread stick 14 moves forward and backward and the stick-shaped cosmetic material M rises and sets with respect to the front end of the main body tube 10. In this case, the stick-shaped cosmetic material M used here is constituted by a stick-shaped cosmetic material formed in an oval shape in cross section.

The main body tube 10 is formed in a stepped cylindrical shape, as shown in FIGS. 3 and 4, which is provided with a front end portion serving as a finger grip portion protruding from the front end of the cartridge receiving container 2, and a receiving portion arranged in the front end portion via an outer peripheral step surface 10*a*, having a small-diameter outer peripheral surface and received in the cartridge receiving container 2.

The front end portion is formed in a tapered shape in which an outer diameter is narrowed gradually toward the front end, and the receiving portion is structured, as shown in FIGS. 10 and 11, such as to be provided with protruding portions (so-called dowel joints) 10*b* for being detachably attached to the cartridge receiving container 2 in the axial direction at three uniform positions in the peripheral direction on an outer peripheral surface close to the outer peripheral step surface 10*a*, and be provided with an annular groove 10*c* at a position between the protruding portion 10*b* and the outer peripheral step surface 10*a*. To the annular groove 10*c*, there is attached an O-ring 15 for applying a rotational resistance to a portion between the first holder 6 of the cartridge receiving container 2 and the main body tube 10 of the stick-shaped cosmetic material cartridge 1 and preventing the stick-shaped cosmetic material cartridge 1 within the cartridge receiving container 2 from being loosen in the diametrical direction.

A tube hole penetrating in the axial direction of the main body tube 10 is structured, as shown in FIG. 11, such that a section from a front end to a center in the axial direction is formed as an oval hole 10*d* receiving the oval stick-shaped cosmetic material M so as to allow to slide, and a section from an end of the oval hole 10*d* to a rear end of the main body tube 10 is formed as a circular shape having a larger diameter than the oval hole. An inner peripheral step surface 10*e* is provided in a midportion in the axial direction of the circular hole, and a rear end side via the inner peripheral step surface 10*e* is formed to have a large diameter. The circular shaped hole having the large-diameter is provided with an annular groove 10*f* for engaging the rear side inner tube 12 constituting the inner tube 11 in the axial direction in a rear end portion side thereof.

Further, as shown in FIG. 4, forward and backward moving grooves 10*g* receiving a support piece 14*d* mentioned below of the thread stick 14 and allowing to slide are provided at a plurality of (four in the present embodiment) positions around the oval hole 10*d* extending to a rear end of the oval hole 10*d* from a portion near the front end of the oval hole 10*d*, and a forward and backward moving hole 10*h* is structured by the oval holes 10*d* and the forward and backward moving grooves 10*g*.

The thread stick 14 is provided with a support portion 14*a* received in the oval hole 10*d* of the main body tube 10, and a shaft body portion 14*b* mainly received in the inner tube 11. The support portion 14*a* supports a rear end portion of the stick-shaped cosmetic material M so as to move forward and backward along the forward and backward moving hole 10*h*, and is structured, as shown in FIG. 4, such as to be provided with a base portion 14*c* having a short oval columnar shape and with which the rear end surface of the stick-shaped cosmetic material M is brought into contact, and support pieces 14*d* arranged at a plurality of (four in the present embodiment) positions in the peripheral direction of the outer peripheral surface of the base portion 14*c* so as to protrude toward the leading end side and supporting an outer peripheral surface in the rear end portion of the stick-shaped cosmetic material M by pinching by inner peripheral surfaces.

The shaft body portion 14*b* is structured, as shown in FIG. 11, such that a leading end portion is formed as a cylindrical shaft portion 14*e*, and a portion from the shaft portion 14*e* to a rear end is formed as a male thread 14*f* having a spiral groove structuring the engagement mechanism in an outer peripheral surface thereof.

The thread stick 14 is structured such that a base portion 14*c* is slidably inside inserted to the oval hole 10*d* of the main body tube 10 and support pieces 14*d* are slidably inside inserted to the forward and backward moving grooves 10*g* of the main body tube 10.

In particular, the inner tube 11, which is forming a feature of the present embodiment, is provided with the inner tube 12 in the rear side in the axial direction and the inner tube 13 in the front side, as shown in FIGS. 13 to 16. These rear side and front side inner tubes 12 and 13 are made of a flexible material, for example, a synthetic resin or the like.

Figure 22:
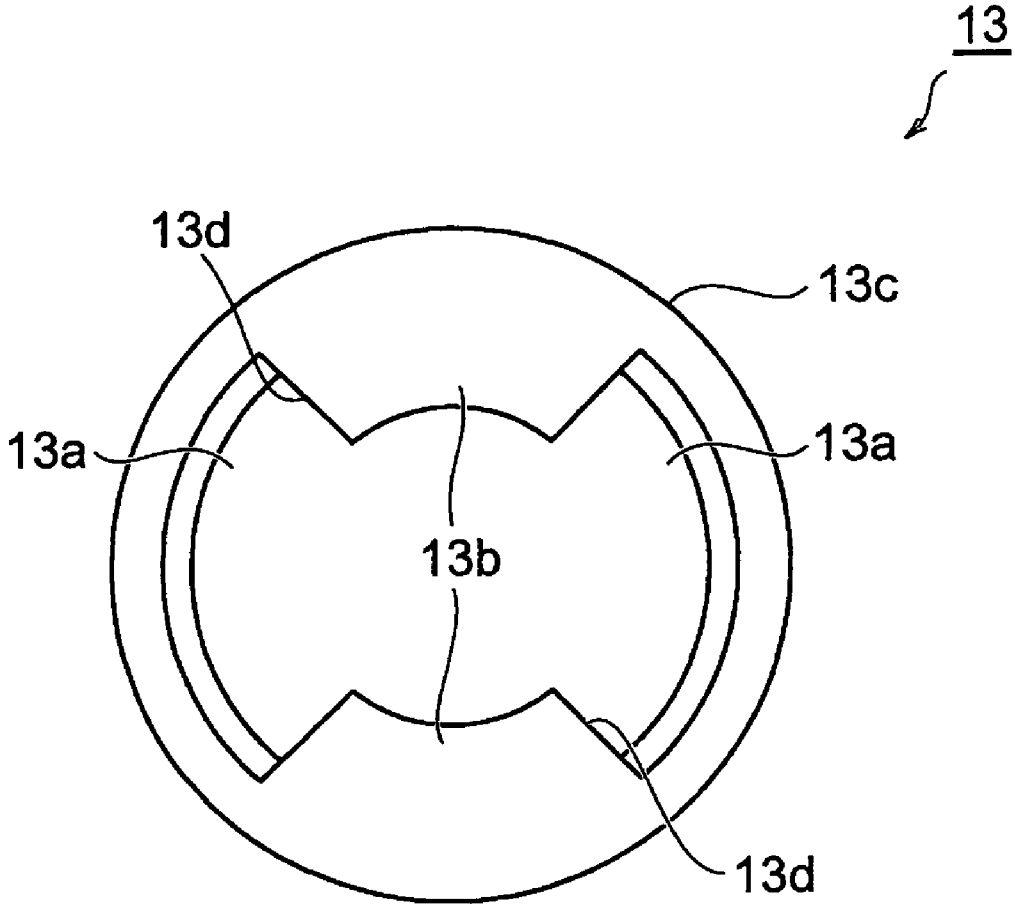
FIG. 22 is a right side view of the front side inner tube in FIG. 21.
Figure 23:
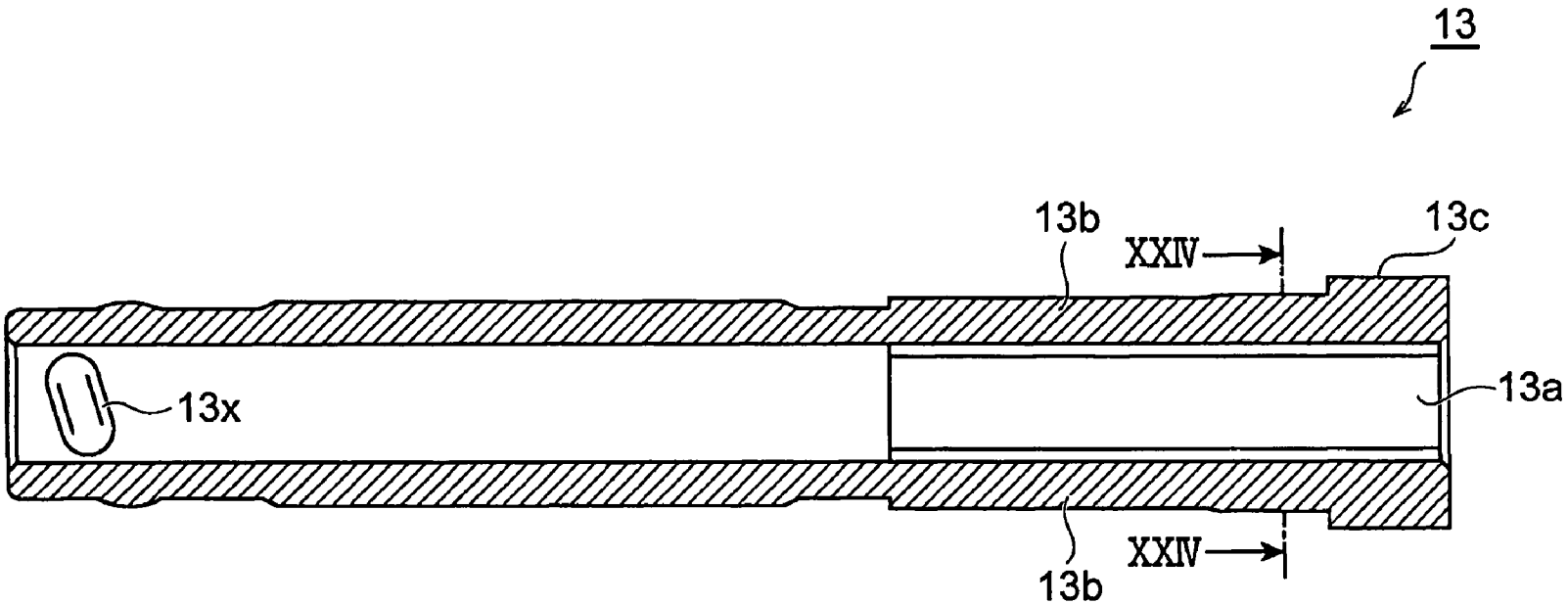
FIG. 23 is a longitudinal sectional view of the front side inner tube shown in FIG. 21.
Figure 24:
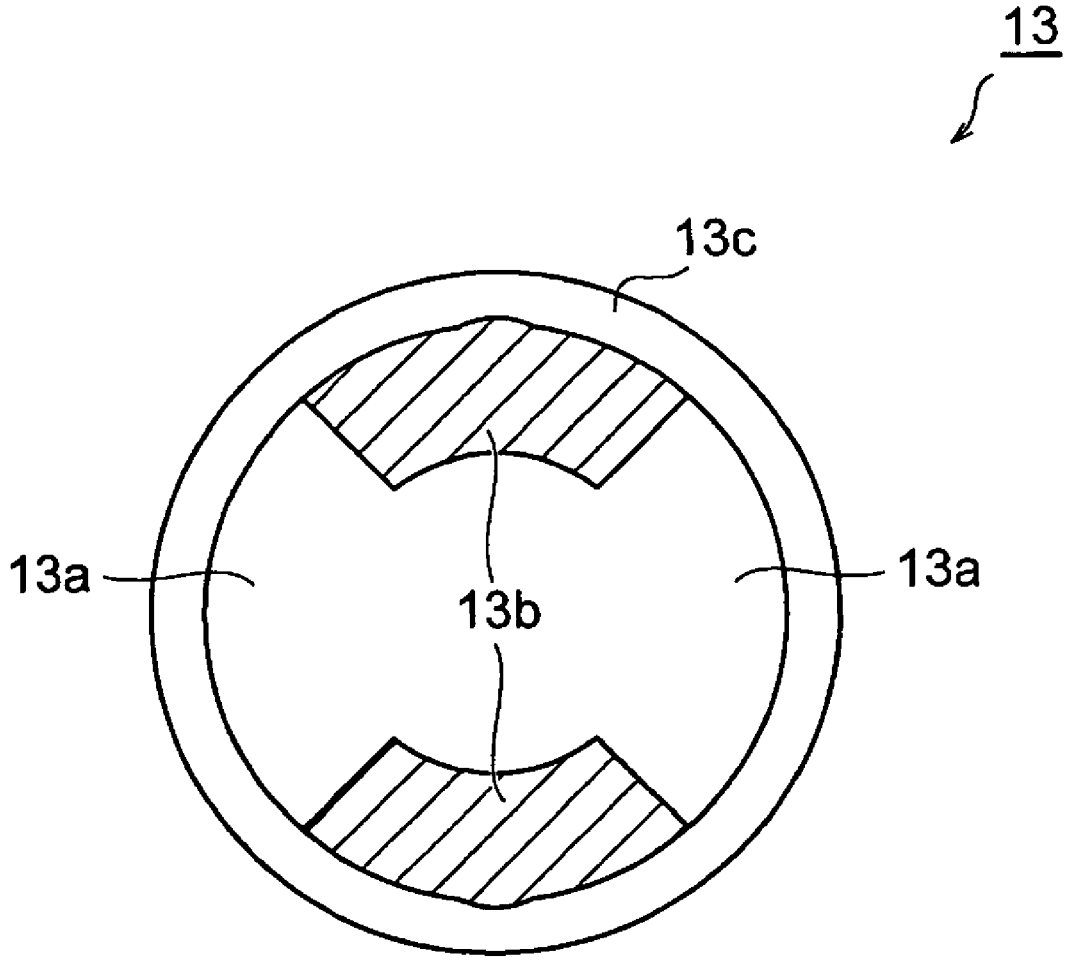
FIG. 24 is a view along a line XXIV-XXIV in FIG. 23.
Figure 25:
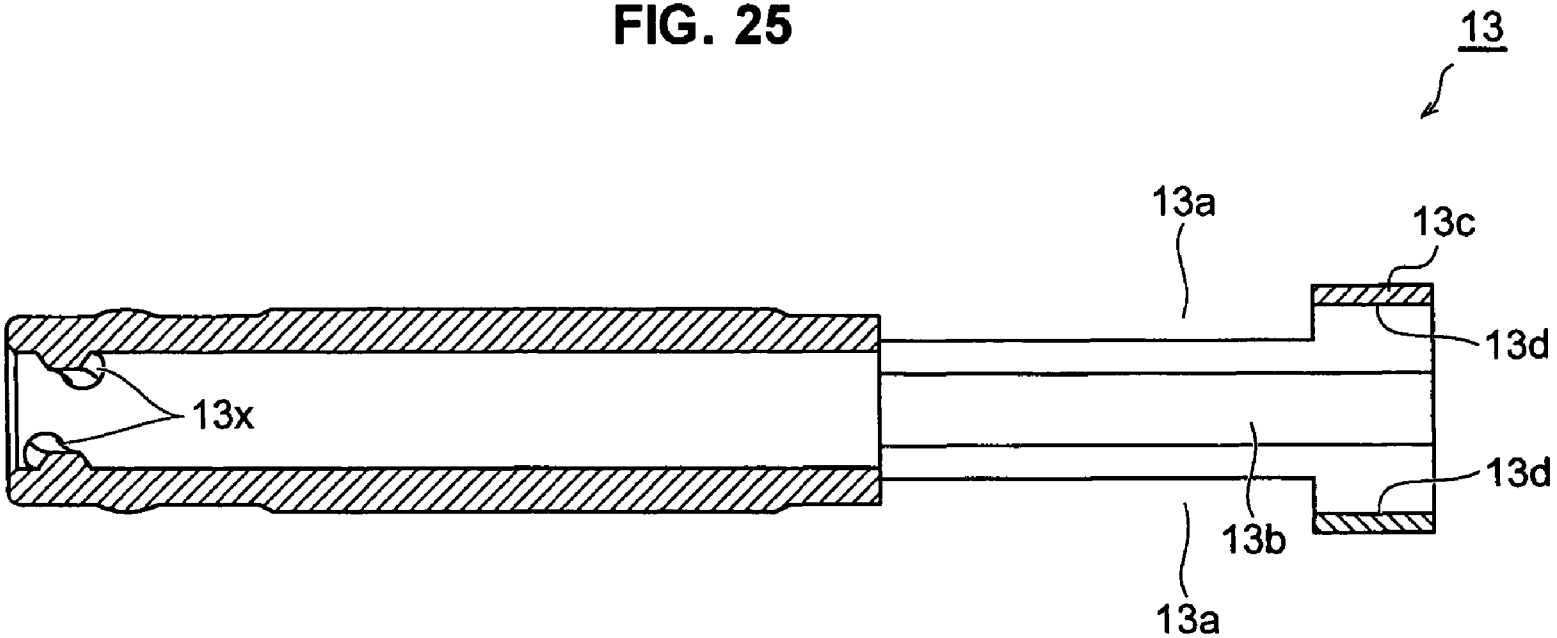
FIG. 25 is an orthogonal longitudinal sectional view of the front side inner tube shown in FIG. 23.
Figure 26:
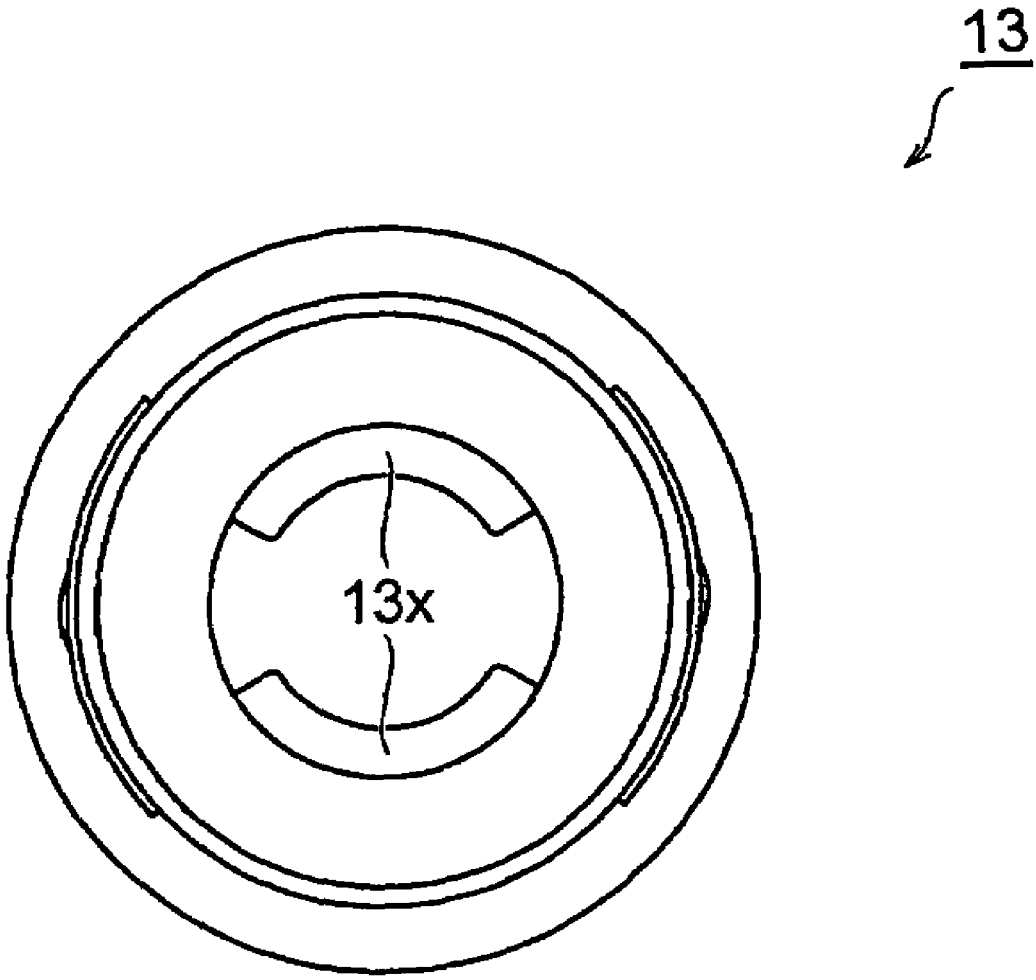
FIG. 26 is a left side view of the front side inner tube shown in FIG. 25.

The front side inner tube 13 is formed in an approximately cylindrical shape as shown in FIGS. 21 to 26, and is provided with a pair of engagement projections structuring the engagement mechanism as female threads 13*x* and 13*x* in an inner peripheral surface of the front end portion, as shown in FIGS. 23, 25 and 26. These female threads 13*x* and 13*x* are respectively provided at 180 degree facing positions in a peripheral direction.

As shown in FIGS. 16 and 21 to 25, slits 13*a* extending in the axial direction are respectively provided at 180 degree facing positions in the peripheral direction, in the rear half portion of the front side inner tube 13, as shown in FIGS. 16 and 21 to 25, and extending walls 13*b* and 13*b* extending in the axial direction are respectively provided in both sides in the peripheral direction of the slits 13*a* so as to form the slits 13*a* and 13*a*. The slits 13*a* and the extending walls 13*b* are provided so as to engage with the rear side inner tube 12 in the rotational direction, and the extending walls 13*b* are formed in an approximate fan-shape in cross section, in which an inner peripheral surface and an outer peripheral surface are formed in a circular arc shape and the outer peripheral surface is made longer in comparison with the inner peripheral surface.

Figure 16:
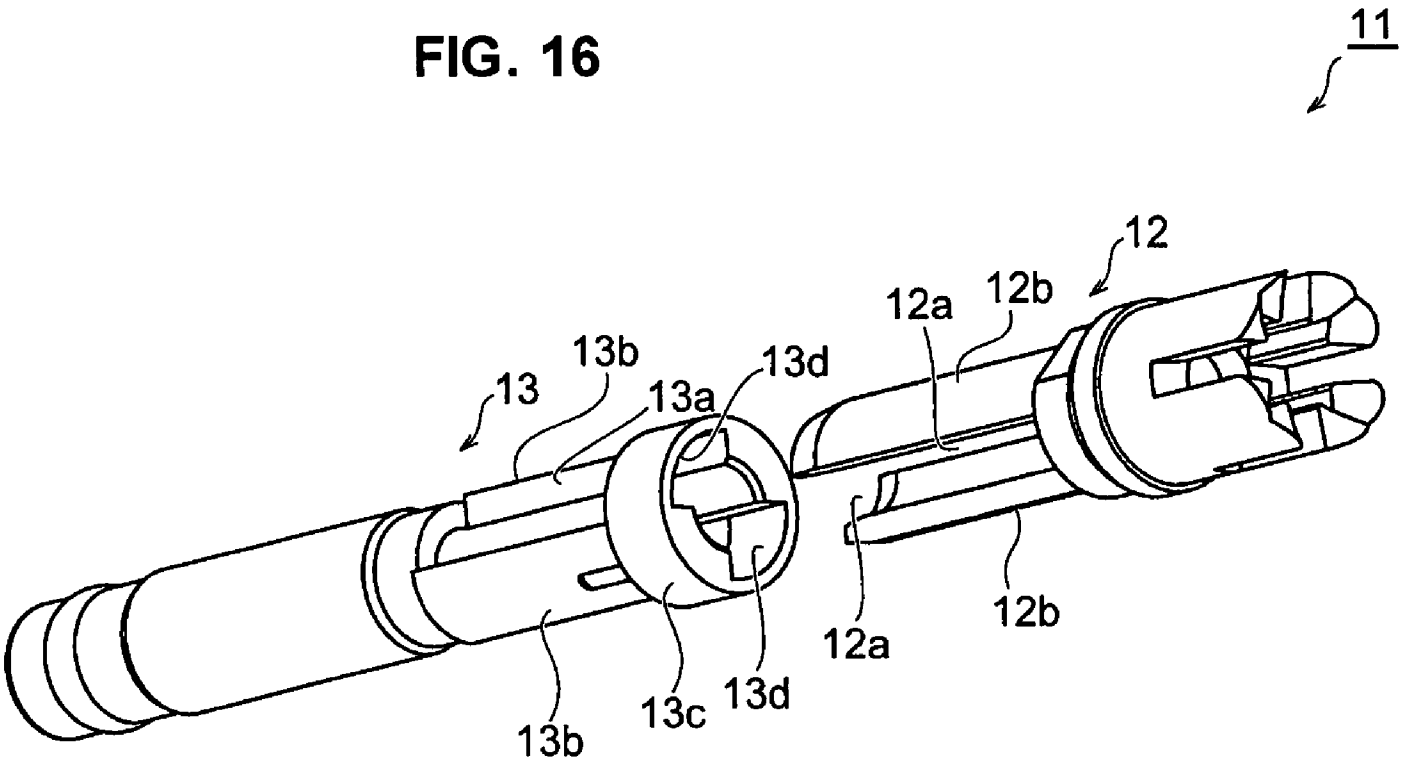
FIG. 16 is an exploded perspective view of the inner tube shown in FIG. 15.

Further, the front side inner tube 13 is provided with an annular portion 13*c* coupling an end portion (a right side end portion in the drawing) of each of the extending walls 13*b* along the peripheral direction, as shown in FIGS. 16, 21 to 23 and 25. The annular portion 13*c* couples outer peripheral surfaces of the extending walls 13*b* from an outer side. Accordingly, the annular portion 13*c* is structured, as shown in FIGS. 16, 22 and 25, such as to have grooves 13*d* connected to the slits 13*a* in the axial direction and open to a rear side in an inner peripheral surface thereof. Further, the extending walls 13*b* are positioned extendedly in both sides of the grooves 13*d* of the annular portion 13*c*, as shown in FIG. 22.

On the other hand, the rear side inner tube 12 is provided with slits 12*a* extending in the axial direction and open to the front side at each of 180 degree facing positions in the peripheral direction, in a front side thereof, as shown in FIGS. 16 to 20, and is provided respectively with extending walls 12*b* and 12*b* extending in the axial direction in both sides in the peripheral direction of the slits 12*a* so as to form the slits 12*a* and 12*a*. The slits 12*a* and the extending walls 12*b* are arranged at positions having the same radius as that of the extending walls 13*b* and the slits 13*a* of the front side inner tube 13, and the extending walls 12*b* are formed in an approximate fan-shape in cross section, in which an inner peripheral surface and an outer peripheral surface are formed in a circular arc shape and the outer peripheral surface is made longer in comparison with the inner peripheral surface, and the cross sectional shape is set equal to that of the extending walls 13*b* of the front side inner tube 13. The extending walls 12*b* of the rear side inner tube 12 can be forward moved to the slits 13*a* in the axial direction via grooves 13*d* of the annular portion 13*c* of the front side inner tube 13, and the slits 12*a* of the rear side inner tube 12 allows the extending walls 13*b* of the front side inner tube 13 to move forward in the axial direction.

Figure 17:
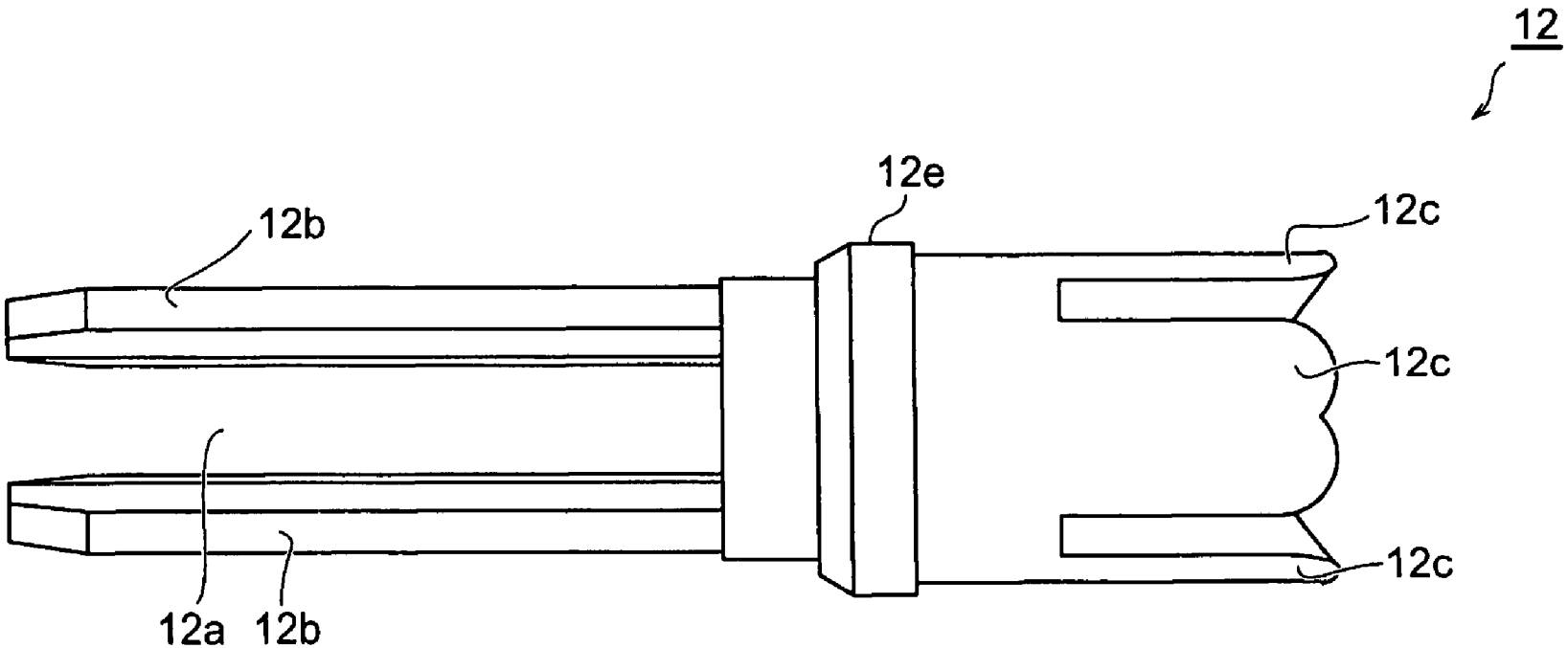
FIG. 17 is a side view showing the rear side inner tube in FIGS. 11 to 16.
Figure 18:
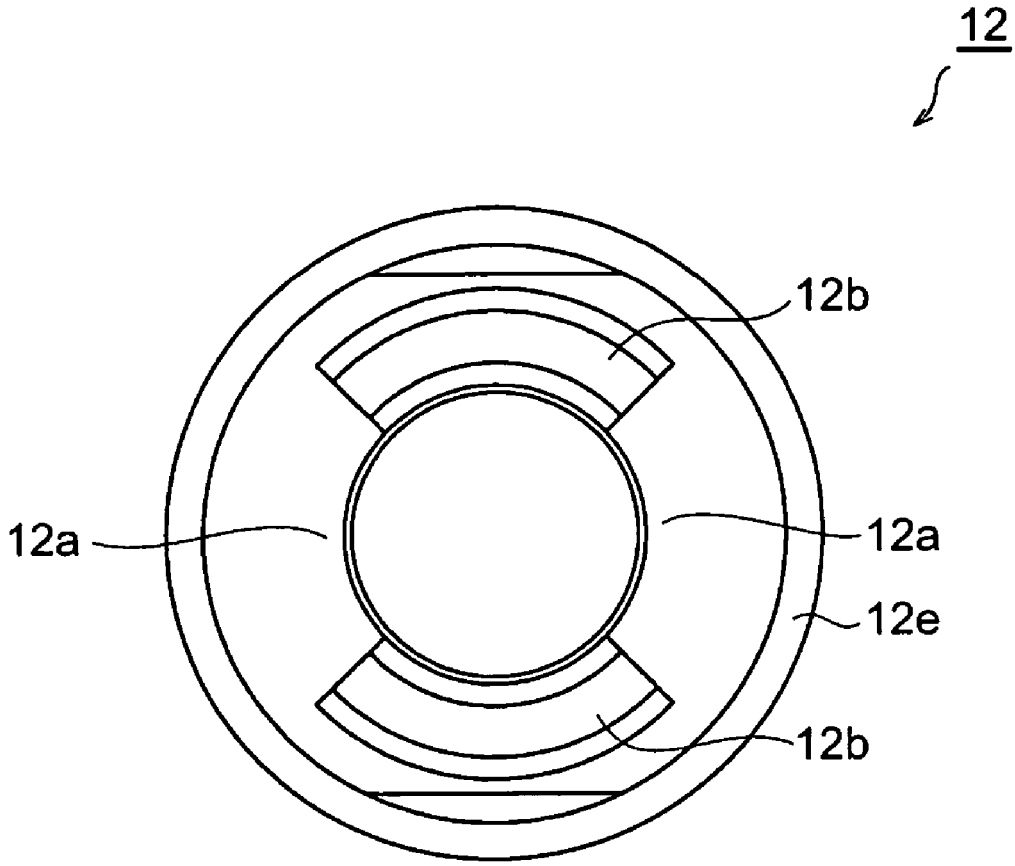
FIG. 18 is a left side view of the rear side inner tube in FIG. 17.
Figure 19:
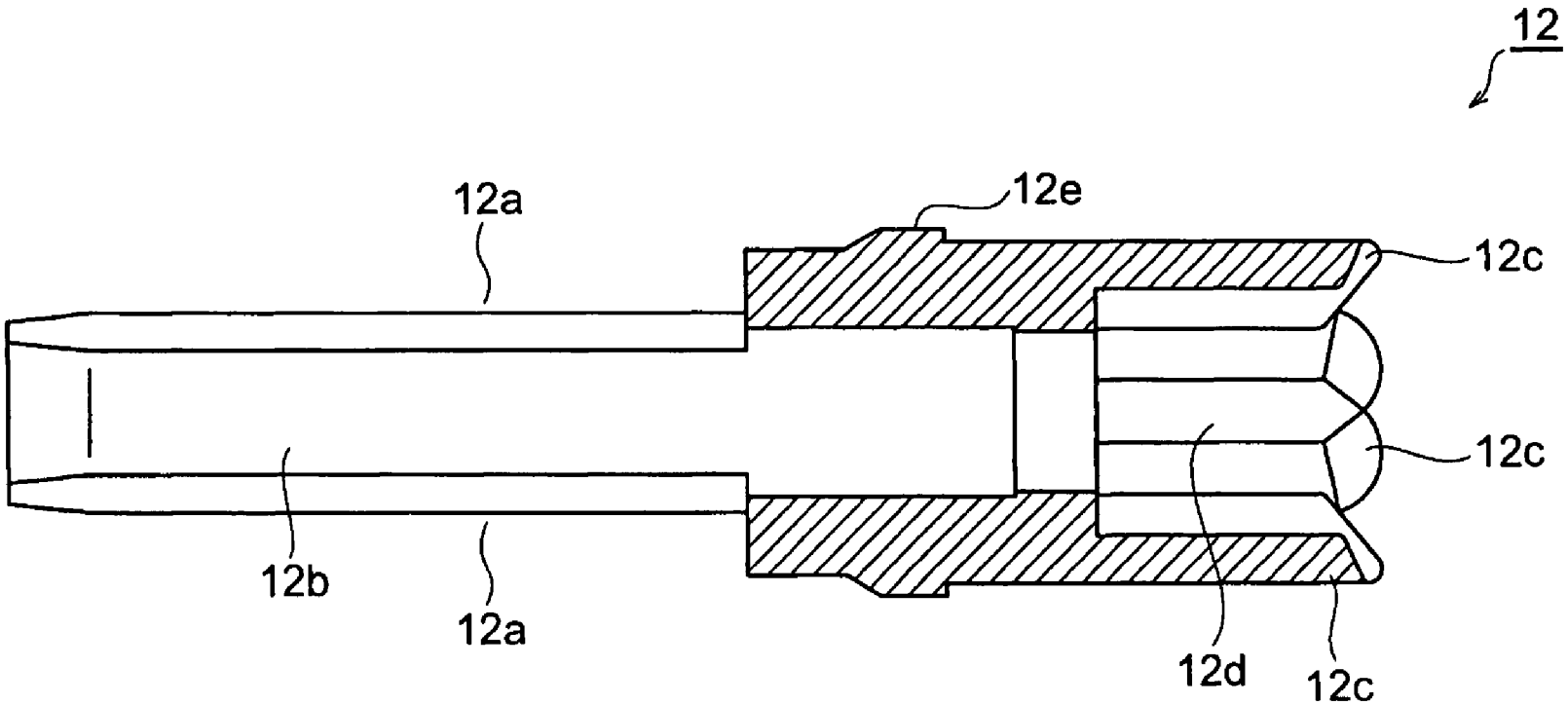
FIG. 19 is an orthogonal longitudinal sectional view of the rear side inner tube in FIG. 17.
Figure 20:
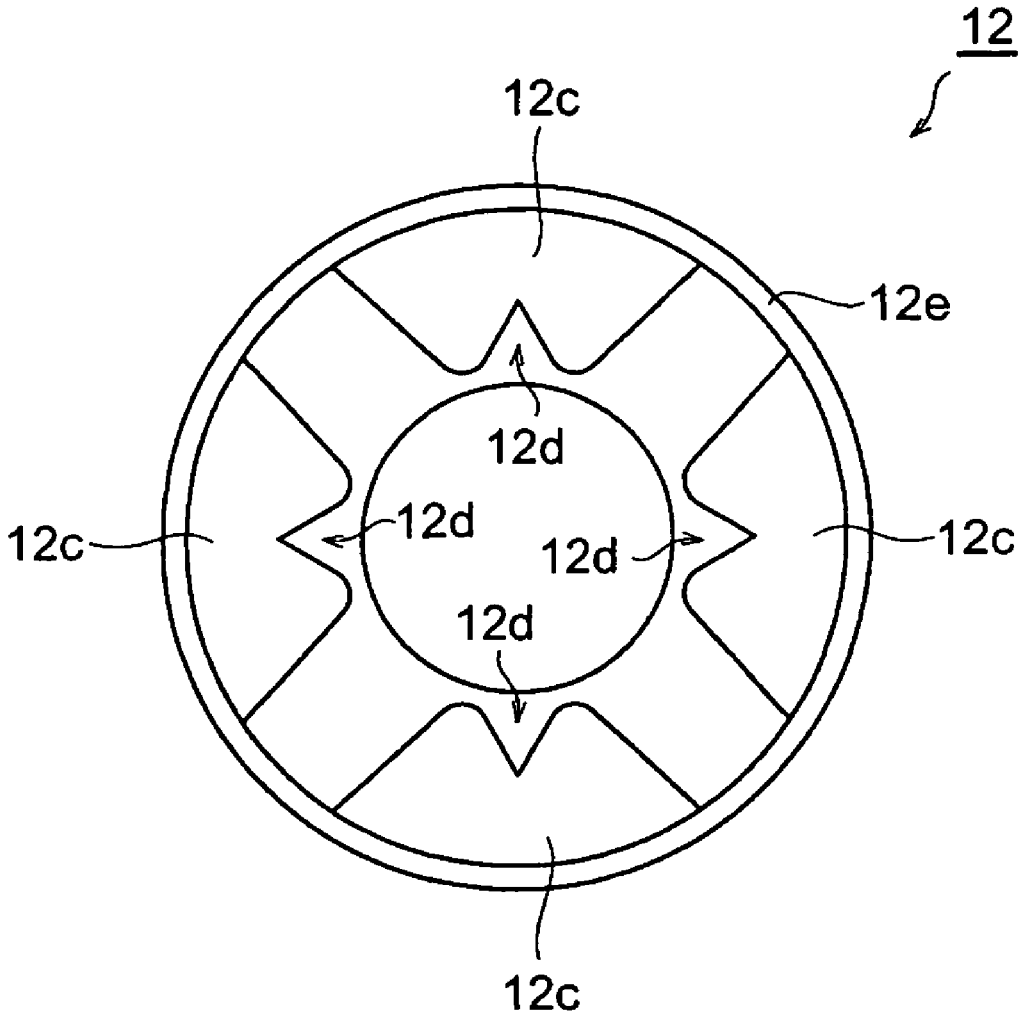
FIG. 20 is a right side view of the rear side inner tube in FIG. 19.
Figure 21:
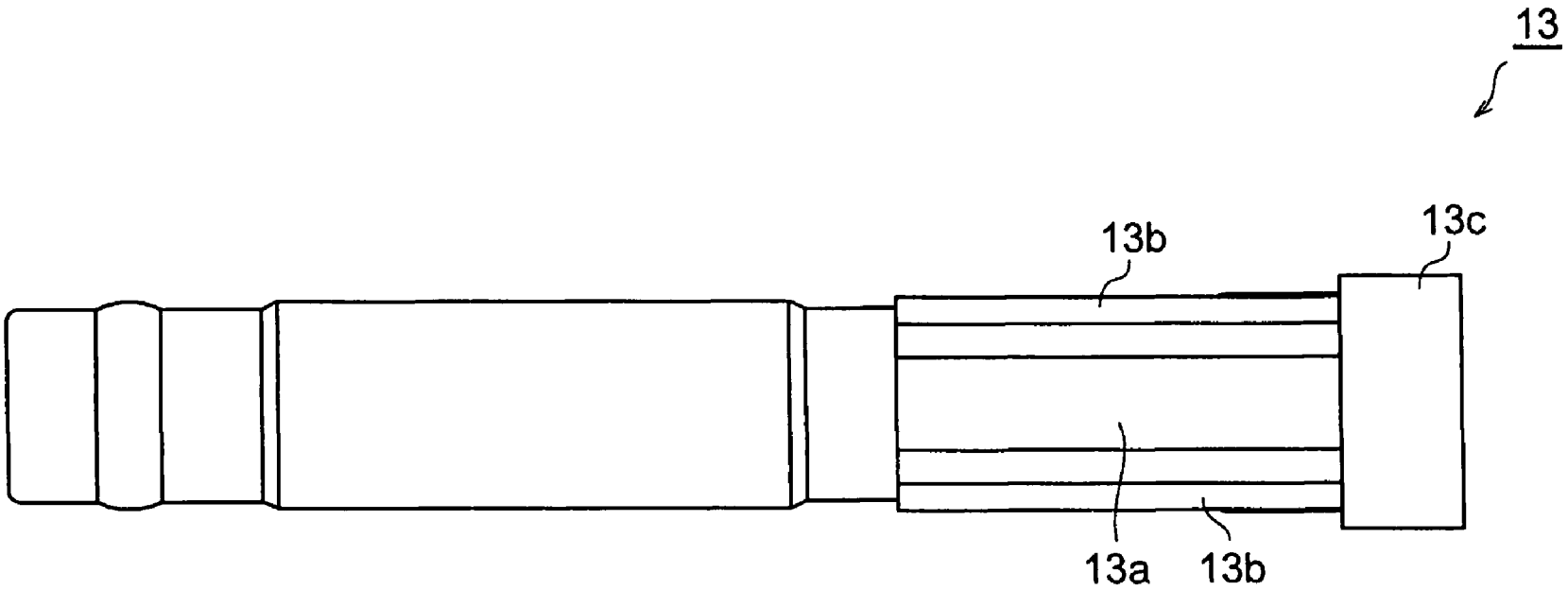
FIG. 21 is a side view showing the front side inner tube in FIG. 21.

Further, the rear side inner tube 12 is provided with elastic protruding portions 12*c* which can be elastically pushed open in a radial direction, in a rear end portion thereof as shown in FIGS. 17, 19 and 20 so as to protrude rearward. The elastic protruding portions 12*c* are provided for engaging with the protruding portions 7*x* of the engagement portion 7*d* of the second holder 7 in a rotational direction. The elastic protruding portions 12*c* are constituted by four pieces of protruding portions arranged at four uniform positions (positions at 90 degree interval) along the peripheral direction, and V-shaped grooves 12*d* extending in an axial direction and to which the triangular chevron-shaped protruding portions 7*x* of the second holder 7 enter, are provided in top portions toward an inner side of the protruding portion. Further, as shown in FIGS. 17 and 19, an annular protruding portion 12*e* for engaging with the annular groove 10*f* of the main body tube 10 in the axial direction is provided in an outer peripheral surface between the extending walls 12*b* and the elastic protruding portion 12*c* in the axial direction of the rear side inner tube 12.

In the rear side and front side inner tubes 12 and 13, as shown in FIGS. 13 to 16, the extending walls 12*b* of the rear side inner tube 12 move forward to the slits 13*a* through the grooves 13*d* of the annular portion 13*c* of the front side inner tube 13, and the extending walls 13*b* of the front side inner tube 13 move forward to the slits 12*a* of the rear side inner tube 12, thereby being coupled so as to be non-rotatable and movable in the axial direction.

Further, the inner tube 11 constituted by the rear side and front side inner tubes 12 and 13 is inside inserted to the main body tube 10 from the front side, as shown in FIG. 11, and the annular protruding portion 12*e* of the rear side inner tube 12 is engaged with the annular groove 10*f* of the main body tube 10, whereby the rear side inner tube 12 is attached to the main body tube 10 so as to be rotatable and immobile in the axial direction.

In this state, the male thread 14*f* of the thread stick 14 is inside inserted to the inner tube 11 from the front side thereof, and the male thread 14*f* is set in an engagement state by being engaged with the female threads 13*x* and 13*x* of the front side inner tube 13. In other words, the thread stick 14 is in an engaged state with the front side inner tube 13.

Further, in this state, a compression coil spring 16 is arranged between the inner peripheral step surface 10*e* of the main body tube 10 and the front side end surface of the annular portion 13*c* of the front side inner tube 13 in such a manner as to surround a rear half portion of the front side inner tube 13 and a front half portion of the rear side inner tube 12 (refer to FIG. 12). The front side inner tube 13 is pressed against the rear side inner tube 12 on the basis of an energizing force of the compression coil spring 16, and is set in a state of being positioned at a backward limit shown in FIG. 11.

In the case of assembling the stick-shaped cosmetic material cartridge 1 having the structure mentioned above, it is preferable to first outside insert the compression coil spring 16 from a rear side of the thread stick 14, next assemble the rear side and front side inner tubes 12 and 13 such that the respective extending walls in the opposite side move forward to the respective slits, next engage the assembled inner tube 12 and the thread stick 14 surrounded by the compression coil spring 16 so as to screw into, next assemble them by inside inserting them from the rear side of the main body tube 10, and finally insert the stick-shaped cosmetic material M from the front side of the main body tube 10 so as to attach to the thread stick 14.

Further, the stick-shaped cosmetic material cartridge 1 is inside inserted to one end side opening of the cartridge receiving container 2 from the rear portion thereof, as shown in FIG. 3, the outer peripheral step surface 10*a* of the main body tube 10 is brought into contact with the end surface of the collar portion 6*a* of the first holder 6 of the cartridge receiving container 2, the O-ring 15 and the protruding portion 10*b* of the main body tube 10 are brought into contact with the inner peripheral surface of the first holder 6 of the cartridge receiving container 2, and the annular protruding portion 6*g* of the first holder 6 of the cartridge receiving container 2 is positioned in the front side of the protruding portion 10*b* of the main body tube 10, whereby the main body tube 10 is rotatably coupled to the cartridge receiving container 2, and can not be moved in the axial direction with respect to the cartridge receiving container 2, except a case that the stick-shaped cosmetic material M is pulled out by a predetermined force of a user, for example, a case that the stick-shaped cosmetic material M reaches an application limit and the stick-shaped cosmetic material cartridge 1 is required to be entirely replaced.

In a state in which the stick-shaped cosmetic material cartridge 1 is attached to the cartridge receiving container 2, the triangular chevron-shaped protruding portions 7*x* of the second holder 7 of the cartridge receiving container 2 move forward to and are engaged with the portions between the elastic protruding portions 12*c* and 12*c* of the rear side inner tube 12 of the stick-shaped cosmetic material cartridge 1 and the V-shaped grooves 12*d* of the elastic protruding portions 12*c*, and the rear side inner tube 12 and the cartridge receiving container 2 are coupled so as to be non-rotatable.

In the stick-shaped cosmetic material feeding container 100 structured as mentioned above, in the case of relatively rotating the cartridge receiving container 2 and the protruding portion of the main body tube 10 of the stick-shaped cosmetic material cartridge 1 from the cartridge receiving container 2 while holding them, since the cartridge receiving container 2 and the rear side inner tube 12 are coupled so as to be non-rotatable, the rear side inner tube 12 and the front side inner tube 13 are coupled so as to be non-rotatable, the female thread 13*x* of the front side inner tube 13 and the male thread 14*f* of the thread rod 14 structure the engagement mechanism, and the support pieces 14*d* of the thread stick 14 and the forward and backward moving grooves 10*g* of the main body tube 10 structure the rotation preventing mechanism, the thread stick 14 smoothly moves forward and backward, and the stick-shaped cosmetic material M protrudes from the front end of the main body tube 10, whereby the application can be executed.

Further, in the stick-shaped cosmetic material feeding container 100 mentioned above, even if the impact and the vibration are applied, for example, due to the drop or the like of the stick-shaped cosmetic material feeding container 100, since the cartridge receiving container 2 and the rear side inner tube 12 are coupled so as to be immobile in the axial direction, and the rear side inner tube 12 and the front side inner tube 13 are coupled so as to be non-rotatable and immobile in the axial direction, the rear side inner tube 12 does not move in the axial direction and it is accordingly possible to maintain a state in which the rotational force is securely applied to the rear side inner tube 12 from the rear side, the front side inner tube 13 moves forward while compressing the compression coil spring 16 against the energizing force of the compression coil spring 16 together with the engagement stick 14 engaging with the front side inner tube 13 in a state of leaving the rear side inner tube 12, and at this time, the front side inner tube 13 moves forward while the extending walls 13*b* thereof slide along the slits 12*a* of the rear side inner tube 12. Accordingly, the impact and the vibration are absorbed on the basis of the forward movement and the compressing effect of the compression coil spring 16, and it is possible to prevent the stick-shaped cosmetic material M from being loosened off from the thread stick 14 and being broken. Further, when the impact ends, the compression coil spring 16 springs the front side inner tube 13, the front side inner tube 13 moves backward while the extending walls 13*b* thereof slide along the slits 12*a* of the rear side inner tube 12, and the front side inner tube 13 and the thread stick 14 are returned to the original positions.

As mentioned above, in the present embodiment, the stick-shaped cosmetic material M well rises and sets with respect to the front end of the main body tube 10, and it is possible to prevent the stick-shaped cosmetic material M from being loosened off and being broken due to the effect of the impact and the vibration. As a result, the feeding function is not deteriorated in comparison with the prior art, and it is possible to provide the stick-shaped cosmetic material cartridge 1 in which the quality is improved.

Further, since the present embodiment is provided with the annular portion 13*c* coupling the front end portion of each of the extending walls 13*b* of the front side inner tube 13 along the peripheral direction, each of the extending walls 13*b* is reinforced by the annular portion 13*c*, and deformation (the collapse) in the thickness direction (inward and the outward) of each of the extending walls 13*b* is well constrained. As a result, it is possible to prevent the extending walls 13*b* and the male thread 14*f* of the thread stick 14 arranged in the inner side of the extending walls 13*b* from being interfered with each other, a desired motion of the thread stick 14 is secured, it is possible to prevent the extending walls 13*b* and the compression coil spring 16 arranged in the outer side of the extending walls 13*b* from being interfered with each other, whereby a desired motion of the compression coil spring 16 is secured.

Further, since the slits 13*a* formed between the extending walls 13*b* and 13*b* of the front side inner tube 13 and the extending walls 12*b* of the rear side inner tube 12 moving forward to the slits 13*a* are formed in the shape constraining inward deformation (the collapse) of the extending walls 12*b*, in particular, the approximate fan-shape in cross section, in which the inner peripheral surface and the outer peripheral surface are formed in the circular arc shaped surface and the outer peripheral surface is made longer in comparison with the inner peripheral surface, it is possible to prevent the male thread 14*f* of the thread stick 14 arranged in the inner side of the extending walls 12*b* and the extending walls 12*b* from being interfered with each other, whereby a desired motion of the thread stick 14 is further secured.

The description is particularly given above of the present invention on the basis of the embodiment, however, the present invention is not limited to the embodiment mentioned above. For example, in the embodiment mentioned above, the structure is made such that the annular portion 13*c* is provided for improving the rigidity of the extending walls 13*b* of the front side inner tube 13, however, the structure may be made such that the annular portion 13*c* of the front side inner tube 13 is omitted, and a similar annular portion thereto is provided so as to couple the outer peripheral surfaces of the front end portions of the extending walls 12*b* of the rear side inner tube 12 in the peripheral direction, thereby improving the rigidity of the extending walls 12*b* of the rear side inner tube 12. Further, if the rigidity of the extending walls 13*b* and 12*b* of the front side and rear side inner tubes is high, the annular portion may be omitted.

Further, in the embodiment mentioned above, the structure is made such that the inward deformation of the extending walls 12*b* is prevented by making the slits 13*a* and the extending walls 12*b* in the approximate fan-shape in cross section, however, the approximate fan-shape in cross section may be inverted so as to prevent the collapse of the outer side of the extending walls 12*b* and prevent the interference with the compression coil spring 16, and may be formed such that a middle portion is bulged like as beads of an abacus so as to constrain the deformation in the thickness direction (inward and outward) of the extending walls 12*b*. In the case that the annular portion 13*c* of the front side inner tube 13 is omitted and the annular portion is provided in the rear side inner tube 12, the extending walls 13*b* of the front side inner tube 13 is prevented from deforming inward and/or outward by the slits 12*a* and the extending walls 12*b* of the rear side inner tube 12, and in the case that the annular portion is provided in none of the rear side and front side inner tubes 12 and 13, the opposite side extending walls are prevented from deforming inward and/or outward by the mutual slits and extending walls.

Further, in the embodiment mentioned above, the structure is made such that, to make the stick-shaped cosmetic material cartridge 1 replaceable, the stick-shaped cosmetic material cartridge 1 is made detachable with respect to the cartridge receiving container 2, however, needless to say, the stick-shaped cosmetic material cartridge 1 may be made non-detachable.

Further, in the embodiment mentioned above, the description is given of the application to the stick-shaped cosmetic material M in which the cross section is formed in the oval shape, however, it is, of course, possible to apply to a stick-shaped cosmetic material in which the cross section is formed in a circular shape. In this case, it is preferable to set the oval hole 10*d* to a circular hole, and set the base portion 14*c* of the support portion 14*a* to a columnar shape.

Further, in the embodiment mentioned above, in order to shorten the stick-shaped cosmetic material cartridge 1, the compression coil spring 16 is arranged between the inner portion of the main body tube 10 and the outer portion of the rear end portion of the front side inner tube 13, that is, between the inner peripheral step surface 10*e* of the main body tube 10 and the front side end surface of the annular portion 13*c* of the front side inner tube 13. However, for example, it is possible to employ a structure in which the compression coil spring 16 is arranged between the inner portion of the main body tube 10 and the front end surface of the front side inner tube 13. The point is that the compression coil spring 16 can energize the front side inner tube 13 to the rear side. Further, the structure of energizing the front side inner tube 13 to the rear side is not limited to the compression coil spring 16, but can employ an energizing means exerting approximately the same function as the compression coil spring 16, for example, a resin spring constituted by a resin or the like.

In this case, the male thread of the thread stick includes an outer portion of a thread stick in which a group of intermittently arranged projections or a group of spirally and intermittently arranged projections having the same function as the thread ridges are formed. Further, the female thread of the inner tube includes an inner portion of an inner tube in which a group of intermittently arranged projections or a group of spirally and intermittently arranged projections having the same function as the thread ridges are formed.

What is claimed is:

1. A stick-shaped cosmetic material cartridge comprising:

a thread stick supporting a rear end portion of a stick-shaped cosmetic material and provided with a male thread in an outer portion; and an inner tube provided with a female thread engaged with said male thread in an inner portion;

an outer tube receiving said thread stick in a front side so as to be non-rotatable and slidable in an axial direction and receiving said inner tube in a rear side;

said stick-shaped cosmetic material being moved forward and backward on the basis of a relative rotation between said outer tube and said inner tube so as to rise and set with respect to a front end of said outer tube, wherein said inner tube has a rear side inner tube which is received in said outer tube so as to be rotatable and immobile in an axial direction and is relatively rotated with said outer tube on the basis of a rotational force applied from a rear side, and a front side inner tube which has said female thread in an inner portion and is coupled to said rear side inner tube so as to be movable in the axial direction and non-rotatable and is received in said outer tube, and an energizing means for energizing said front side inner tube to a rear side is arranged between an inner portion of said outer tube and an outer portion of said front side inner tube.

2. A stick-shaped cosmetic material cartridge as claimed in claim 1, wherein said front side inner tube is provided with a plurality of slits extending in the axial direction and open to the rear side along a peripheral direction, and extending walls positioned in both sides in the peripheral direction of said slits so as to form the slits and extending in the axial direction, in the rear side, said rear side inner tube is provided with a plurality of slits extending in the axial direction, open to the front side and to which said extending walls of said front side inner tube enter in the axial direction along the peripheral direction, and is provided with extending walls positioned in both sides in the peripheral direction of said slits so as to form the slits, extending in the axial direction and enters to said slits of said front side inner tube in the axial direction, and said front side inner tube is coupled to said rear side inner tube so as to be movable in the axial direction and non-rotatable by the slits and the extending walls.

3. A stick-shaped cosmetic material cartridge as claimed in claim 2, wherein said slits formed between the extending walls in the peripheral direction and the extending walls entering to the slits are formed in such a shape as to constrain deformation of said extending walls in a thickness direction.

4. A stick-shaped cosmetic material cartridge as claimed in claim 3, wherein said extending walls are formed in an approximate fan-shape in cross section, in which the inner peripheral surfaces and the outer peripheral surfaces are formed to be circular arc shaped surfaces and said outer peripheral surfaces are made longer than said inner peripheral surfaces.

5. A stick-shaped cosmetic material cartridge as claimed in claim 4, wherein an annular portion coupling a front end portion of each of the extending walls in any one of said front side inner tube and said rear side inner tube along the peripheral direction is provided, and the annular portion is provided with grooves connecting to the slits of one inner tube provided with the annular portion in the axial direction and allowing the extending walls of the other inner tube to enter to the slits in the axial direction, in an inner peripheral surface.

6. A stick-shaped cosmetic material cartridge as claimed in claim 3, wherein an annular portion coupling a front end portion of each of the extending walls in any one of said front side inner tube and said rear side inner tube along the peripheral direction is provided, and the annular portion is provided with grooves connecting to the slits of one inner tube provided with the annular portion in the axial direction and allowing the extending walls of the other inner tube to enter to the slits in the axial direction, in an inner peripheral surface.

7. A stick-shaped cosmetic material cartridge as claimed in claim 2, wherein an annular portion coupling a front end portion of each of the extending walls in any one of said front side inner tube and said rear side inner tube along the peripheral direction is provided, and the annular portion is provided with grooves connecting to the slits of one inner tube provided with the annular portion in the axial direction and allowing the extending walls of the other inner tube to enter to the slits in the axial direction, in an inner peripheral surface.

* * * * *